US009383126B2

(12) United States Patent
Chen et al.

(10) Patent No.: US 9,383,126 B2
(45) Date of Patent: Jul. 5, 2016

(54) REFRIGERANT CHARGE MANAGEMENT IN A HEAT PUMP WATER HEATER

(71) Applicant: NORTEK GLOBAL HVAC LLC, O'Fallon, MO (US)

(72) Inventors: Jie Chen, St. Charles, MO (US); Justin W. Hampton, Bonne Terre, MO (US)

(73) Assignee: Nortek Global HVAC, LLC, O'Fallon, MO (US)

( * ) Notice: Subject to any disclaimer, the term of this patent is extended or adjusted under 35 U.S.C. 154(b) by 0 days.

(21) Appl. No.: 14/278,982

(22) Filed: May 15, 2014

(65) Prior Publication Data

US 2014/0245770 A1 Sep. 4, 2014

Related U.S. Application Data

(63) Continuation-in-part of application No. 13/548,091, filed on Jul. 12, 2012, now Pat. No. 8,756,943.

(60) Provisional application No. 61/578,753, filed on Dec. 21, 2011.

(51) Int. Cl.
*F25B 30/00* (2006.01)
*F25B 30/02* (2006.01)
(Continued)

(52) U.S. Cl.
CPC ..... *F25B 29/003* (2013.01); *F24D 19/1072* (2013.01); *F25B 13/00* (2013.01);
(Continued)

(58) Field of Classification Search
CPC ..... F25B 2339/045; F25B 2339/046; F25B 2341/066; F25B 2341/0661; F25B 6/02; F25B 30/00; F25B 30/02; F25B 30/06; F25B 2345/006; F25B 2345/003; F25B 2400/0403; F25B 2400/0409; F25B 2600/05; F25B 2700/04; F25B 2313/003; F25B 2313/004; F25B 2313/0214; F25B 2313/0215; F25B 2313/021; F25B 40/04; F25B 41/04; F25B 41/043
See application file for complete search history.

(56) References Cited

U.S. PATENT DOCUMENTS 2,976,698 A 8/1961 Muffly
3,158,006 A 11/1964 Skeats et al.
(Continued)

FOREIGN PATENT DOCUMENTS

EP 0134015 3/1985
JP 2006011201 1/1994
(Continued)

OTHER PUBLICATIONS

ISR and Written Opinion for corresponding Int'l Application No. PCT/US2012/070271 dated Apr. 24, 2013.
(Continued)

*Primary Examiner* — Frantz Jules
*Assistant Examiner* — Erik Mendoza-Wilkenfel
(74) *Attorney, Agent, or Firm* — Schwegman Lundberg & Woessner, P.A.

(57) ABSTRACT

Heat pumps that heat or cool a space and that also heat water, refrigerant management systems for such heat pumps, and methods of managing refrigerant charge. Various embodiments remove idle refrigerant from a heat exchanger that is not needed for transferring heat by opening a refrigerant recovery valve and delivering the idle refrigerant from the heat exchanger to an inlet port on the compressor. The heat exchanger can be isolated by closing an electronic expansion valve, actuating a refrigerant management valve, or both. Refrigerant charge can be controlled by controlling how much refrigerant is drawn from the heat exchanger, by letting some refrigerant back into the heat exchanger, or both. Heat pumps can be operated in different modes of operation, and various components can be interconnected with refrigerant conduit. Some embodiments deliver refrigerant gas to the heat exchanger and drive liquid refrigerant out prior to isolating the heat exchanger.

16 Claims, 6 Drawing Sheets

(51) Int. Cl.

| | |
|---|---|
| ***F25B 30/06*** | (2006.01) |
| ***F25B 41/04*** | (2006.01) |
| ***F25B 40/04*** | (2006.01) |
| ***F25B 29/00*** | (2006.01) |
| ***F25B 13/00*** | (2006.01) |
| ***F24D 19/10*** | (2006.01) |

(52) U.S. Cl.

CPC ... *F25B2313/005* (2013.01); *F25B 2313/0292* (2013.01); *F25B 2313/02731* (2013.01); *F25B 2313/02741* (2013.01); *F25B 2339/047* (2013.01)

(56) References Cited

U.S. PATENT DOCUMENTS

| | | | | |
|---|---|---|---|---|
| 3,177,674 | A | 4/1965 | Spofford | |
| 3,188,829 | A | 6/1965 | Siewert et al. | |
| 2,715,317 | A | 8/1965 | Rhodes | |
| 3,200,605 | A | 8/1965 | Brody | |
| 3,238,737 | A | 3/1966 | Shrader et al. | |
| 3,264,838 | A * | 8/1966 | Johnson | 62/149 |
| 3,301,002 | A | 1/1967 | McGrath | |
| 3,916,638 | A | 11/1975 | Schmidt | |
| 3,938,352 | A | 2/1976 | Schmidt | |
| 3,994,142 | A | 11/1976 | Kramer | |
| 4,072,187 | A | 2/1978 | Lodge | |
| 4,098,092 | A | 7/1978 | Singh | |
| 4,134,274 | A | 1/1979 | Johnsen | |
| 4,165,037 | A * | 8/1979 | McCarson | F24F 3/001 237/1 R |
| 4,179,894 | A | 12/1979 | Hughes | |
| 4,238,933 | A | 12/1980 | Coombs | |
| 4,240,269 | A | 12/1980 | Bussjager | |
| 4,249,390 | A | 2/1981 | Jones | |
| 4,299,098 | A | 11/1981 | Derosier | |
| 4,399,664 | A | 8/1983 | Derosier | |
| 4,409,796 | A | 10/1983 | Fisher | |
| 4,492,092 | A | 1/1985 | Smorol et al. | |
| 4,493,193 | A | 1/1985 | Fisher | |
| 4,528,822 | A | 7/1985 | Glamm | |
| 4,553,401 | A | 11/1985 | Fisher | |
| 4,598,557 | A | 7/1986 | Robinson et al. | |
| 4,645,908 | A | 2/1987 | Jones | |
| 4,646,537 | A | 3/1987 | Crawford | |
| 4,646,538 | A | 3/1987 | Blackshaw et al. | |
| 4,693,089 | A | 9/1987 | Bourne et al. | |
| 4,765,149 | A | 8/1988 | Shiga et al. | |
| 4,766,734 | A | 8/1988 | Dudley | |
| 4,776,180 | A | 10/1988 | Patton, Sr. et al. | |
| 4,798,059 | A | 1/1989 | Morita | |
| 4,840,037 | A | 6/1989 | Yamada et al. | |
| 4,893,476 | A | 1/1990 | Bos et al. | |
| 4,924,681 | A * | 5/1990 | DeVit et al. | 62/238.6 |
| 4,940,079 | A | 7/1990 | Best et al. | |
| 4,966,006 | A | 10/1990 | Thuesen et al. | |
| 5,044,168 | A | 9/1991 | Wycoff | |
| 5,081,848 | A | 1/1992 | Rawlings et al. | |
| 5,140,827 | A | 8/1992 | Reedy | |
| 5,165,250 | A | 11/1992 | Nagatomo et al. | |
| 5,184,472 | A | 2/1993 | Guilbault et al. | |
| 5,211,029 | A | 5/1993 | Uselton et al. | |
| 5,261,249 | A | 11/1993 | Manz | |
| 5,269,153 | A | 12/1993 | Cawley | |
| 5,307,642 | A | 5/1994 | Dean | |
| 5,339,890 | A | 8/1994 | Rawlings | |
| 5,372,016 | A | 12/1994 | Rawlings | |
| 5,465,588 | A * | 11/1995 | McCahill et al. | 62/127 |
| 5,467,812 | A | 11/1995 | Dean et al. | |
| 5,477,914 | A | 12/1995 | Rawlings | |
| 5,495,723 | A | 3/1996 | MacDonald et al. | |
| 5,533,355 | A | 7/1996 | Rawlings | |
| 5,564,282 | A | 10/1996 | Kaye | |
| 5,651,265 | A | 7/1997 | Grenier | |
| 5,653,120 | A | 8/1997 | Meyer | |
| 5,784,892 | A | 7/1998 | Reedy | |
| 5,802,864 | A | 9/1998 | Yarbrough et al. | |
| 5,901,563 | A | 5/1999 | Yarbrough et al. | |
| 6,082,125 | A * | 7/2000 | Savtchenko | 62/238.6 |
| 6,253,564 | B1 | 7/2001 | Yarbrough et al. | |
| 6,286,322 | B1 | 9/2001 | Vogel et al. | |
| 6,385,983 | B1 | 5/2002 | Sakki et al. | |
| 6,615,602 | B2 | 9/2003 | Wilkinson | |
| 6,862,894 | B1 | 3/2005 | Miles | |
| 7,185,505 | B2 | 3/2007 | Kamimura | |
| 7,913,501 | B2 | 3/2011 | Ellis et al. | |
| 8,056,348 | B2 | 11/2011 | Murakami et al. | |
| 2004/0079096 | A1 * | 4/2004 | Itoh et al. | 62/223 |
| 2004/0182101 | A1 | 9/2004 | Shimoda et al. | |
| 2005/0016204 | A1 | 1/2005 | Zhang | |
| 2006/0101838 | A1 | 5/2006 | Ritchey | |
| 2006/0218949 | A1 | 10/2006 | Ellis et al. | |
| 2007/0006602 | A1 | 1/2007 | Hayashi et al. | |
| 2007/0209380 | A1 | 9/2007 | Mueller et al. | |
| 2008/0016888 | A1 | 1/2008 | Kates | |
| 2008/0041072 | A1 | 2/2008 | Seefeldt | |
| 2008/0083237 | A1 * | 4/2008 | Street et al. | 62/196.4 |
| 2008/0190130 | A1 | 8/2008 | Murakami et al. | |
| 2008/0197206 | A1 | 8/2008 | Murakami et al. | |
| 2008/0245087 | A1 | 10/2008 | Orcutt | |
| 2008/0307819 | A1 | 12/2008 | Pham | |
| 2009/0013702 | A1 | 1/2009 | Murakami et al. | |
| 2009/0044547 | A1 | 2/2009 | Oswald | |
| 2009/0049857 | A1 | 2/2009 | Murakami et al. | |
| 2010/0058791 | A1 | 3/2010 | Quesada Saborio | |
| 2010/0077788 | A1 | 4/2010 | Lewis | |
| 2011/0100043 | A1 | 5/2011 | Matubara et al. | |
| 2011/0192176 | A1 * | 8/2011 | Kim et al. | 62/115 |
| 2011/0289952 | A1 | 12/2011 | Kim et al. | |
| 2014/0123689 | A1 | 5/2014 | Ellis et al. | |
| 2015/0033779 | A1 | 2/2015 | Seggerman | |
| 2015/0040841 | A1 | 2/2015 | Leman et al. | |
| 2015/0052914 | A1 | 2/2015 | Leman et al. | |

FOREIGN PATENT DOCUMENTS

| | | |
|---|---|---|
| JP | 2000046417 | 2/2000 |
| KR | 200309412 | 3/2003 |
| WO | 9600370 | 1/1996 |
| WO | 2013142760 | 9/2013 |

OTHER PUBLICATIONS

ISR and Written Opinion for Corresponding Int'l Application No. PCT/US2013/033433 filed Mar. 22, 2013.

* cited by examiner

REFRIGERANT CHARGE MANAGEMENT IN A HEAT PUMP WATER HEATER

RELATED PATENT APPLICATIONS

This patent application is a continuation-in-part (CIP) patent application of, and claims priority to, U.S. patent application Ser. No. 13/548,091, filed on Jul. 12, 2012, titled: Refrigerant Management for Heat Pump Water Heater, which is a non-provisional patent application of, and claims priority to, U.S. Provisional Patent Application No. 61/578,753, filed on Dec. 21, 2011, titled Refrigerant Management for Heat Pump Water Heater, Apparatus and Methods. These patent applications have at least one inventor in common with the current patent application and the same assignee. The contents of these priority patent applications are incorporated herein by reference. Certain terms, however, may be used differently.

LICENSE RIGHTS

This invention was made under CRADA NFE-11-03561 between Nordyne and UT-Battelle, LLC, operating and management Contractor for the Oak Ridge National Laboratory for the United States Department of Energy. The Government has certain rights in this invention.

FIELD OF THE INVENTION

This invention relates to heat pumps that heat and cool a space and that also heat water, and systems and methods for managing refrigerant charge in such heat pumps.

BACKGROUND OF THE INVENTION

A heat pump is a machine or device that transfers thermal energy from one location, at a lower temperature, to another location, which is at a higher temperature. Accordingly, heat pumps move thermal energy in a direction opposite to the direction that it normally flows. Some types of heat pumps are dedicated to cooling only, some types are dedicated to heating only, and some types perform both functions, for instance, depending on whether heating or cooling is needed at the time. Heat pump HVAC units have been used for some time to heat and cool spaces that people occupy such as the interior of buildings. Heat pumps have also been used for other purposes such as heating water. Heat pumps are typically more efficient than alternative heat sources, such as electrical resistance heating, because heat pumps extract heat from another source, such as the environment, in addition to providing heat produced from the consumption of electrical power. Further, in some situations, the heating and the cooling are both put to beneficial use at the same time, such as heating domestic hot water while cooling air for air conditioning. As a result, heat pumps often reduce energy consumption in comparison with other alternatives.

Heat pumps have been used that heat and cool an enclosed space within a building and that also heat domestic hot water. A problem encountered with such systems, however, is that an appropriate refrigerant charge for one mode of operation has been inappropriate (i.e., insufficient refrigerant charge or excessive refrigerant charge) in another mode of operation. For example, during conditions under which a particular heat exchanger of the heat pump is not needed for transferring heat, liquid refrigerant has accumulated in that heat exchanger reducing the available charge for the system to an inappropriately low level of charge. This has occurred, for example, during conditions under which the outdoor heat exchanger is not needed for transferring heat, while the water is being heated and the space is being cooled. This has also occurred, as another example, during conditions under which the indoor heat exchanger is not needed for transferring heat, while the water is being heated and heat is being extracted from the outdoor air. In the past, it was necessary to correct or compensate for these inappropriate refrigerant charge levels in different modes of operation with complex and expensive refrigerant charge management hardware and systems, or else it was necessary to avoid certain modes of operation such as those modes just mentioned, or the heat pumps operated substantially less efficiently during such modes of operation.

Further, U.S. Pat. No. 4,299,098 (Derosier) describes controlling refrigerant charge in a heat pump water heater by venting an inactive heat exchanger to the suction side of the compressor. The heat pump of Derosier, however, is not able to heat the space and heat water at the same time, and is not able to heat water while also rejecting heat to the environment while the space is being cooled. In addition, the heat pump of Derosier requires many expensive components, including control valves and check valves.

As a result, needs or potential for benefit or improvement exist for refrigerant charge management methods and systems for heat pumps that also heat water that are less expensive, that utilize existing components to a greater extent, that provide for more modes of operation of the heat pump, that increase the efficiency of the heat pump, at least during particular modes of operation, that are less complex, that can be readily manufactured, that are easy to install, that are reliable, that have a long life, that are compact, that can withstand extreme environmental conditions, or a combination thereof, as examples. Further, needs or potential for benefit or improvement exist for methods of controlling, manufacturing, and distributing such heat pumps, HVAC units, buildings, systems, devices, and apparatuses. Other needs or potential for benefit or improvement may also be described herein or known in the HVAC, domestic hot water heater, or heat pump industries, for example. Room for improvement exists over the prior art in these and other areas that may be apparent to a person of ordinary skill in the art having studied this document.

Further background information describing certain aspects of prior art and problems therein includes U.S. Pat. No. 5,140,827, issued to Wayne R. Reedy on Aug. 25, 1992. Potential for benefit exists over the prior art including managing refrigerant charge with fewer components, less expensively, more reliably, or a combination thereof.

BRIEF DESCRIPTION OF THE DRAWINGS

that also heats water, the heat pump having an improved system to manage refrigerant charge that includes a refrigerant recovery valve.

Figure 1:
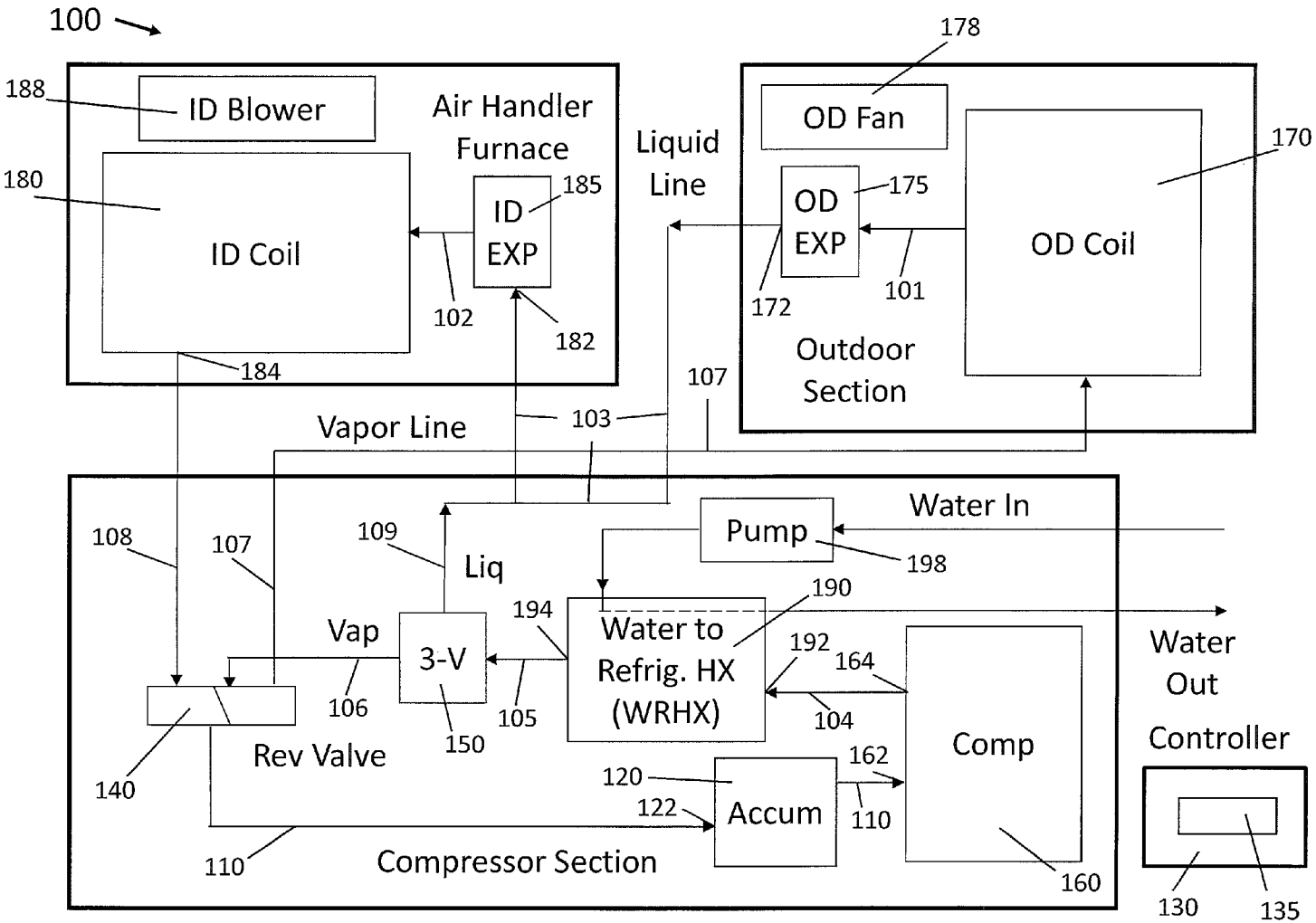
FIG. 1 is a block diagram illustrating an example of a heat pump operating in a cooling mode (i.e., cooling the space) that also heats water, the heat pump having an improved system to manage refrigerant charge.

These drawings illustrate, among other things, examples of certain aspects of particular embodiments of the invention. Other embodiments may differ. For example, in some embodiments, components or acts may be omitted, or acts may be performed in a different order. Various embodiments may include aspects shown in the drawings, described in the specification, shown or described in other documents that are incorporated by reference, known in the art, or a combination thereof, as examples.

SUMMARY OF PARTICULAR EMBODIMENTS OF THE INVENTION

This invention provides, among other things, heat pumps that heat and cool a space and that also heat water (e.g., domestic hot water), systems and methods of managing refrigerant charge in such heat pumps, and systems and methods for heating and cooling a space and for heating water. Particular embodiments deliver hot refrigerant gas to a particular heat exchanger of the heat pump that is not needed at that time for transferring heat, driving liquid refrigerant out of that particular heat exchanger, and then isolate the particular heat exchanger against additional refrigerant flowing into the particular heat exchanger. The heat pump is then operated while the particular heat exchanger is isolated. Various embodiments remove idle refrigerant from a heat exchanger that is not needed for transferring heat by opening a refrigerant recovery valve and delivering the idle refrigerant from the heat exchanger to an inlet port on the compressor.

In some embodiments, the heat exchanger is isolated by closing an electronic expansion valve, actuating a refrigerant management valve, or both. Refrigerant charge can be controlled, in some embodiments, by controlling how much refrigerant is drawn from the heat exchanger, by letting some refrigerant back into the heat exchanger, or both, for example, while the heat pump is being operated. Certain embodiments include a digital controller programmed to control the heat pump, which can include specific programming instructions, or include specific components, such as one or more expansion devices and one or more refrigerant management valves, that are used to isolate the particular heat exchanger. Further, in some embodiments, components are arranged in a particular manner, for example, with certain refrigerant conduits connecting different components.

Various embodiments provide, for example, as an object or benefit, that they partially or fully address or satisfy one or more of the needs, potential areas for benefit, or opportunities for improvement described herein, or known in the art, as examples. Certain embodiments provide, for instance, heat pumps that also heat water (e.g., domestic hot water) and refrigerant charge management methods and systems for heat pumps that also heat water that are less expensive, that utilize existing components to a greater extent, that provide for more modes of operation of the heat pump, that increase the efficiency of the heat pump, at least during particular modes of operation, that are less complex, that can be readily manufactured, that are relatively inexpensive, that tolerate a certain amount of refrigerant leakage through various valves, that are easy to install, that are reliable, that have a long life, that are compact, that can withstand extreme environmental conditions, or a combination thereof, as examples.

Specific embodiments of the invention provide various heat pumps that heat or cool a space and also heat water. In a number of embodiments, the heat pump includes an outdoor heat exchanger that transfers heat, for example, between refrigerant and outdoor air or a heat source/sink, an indoor heat exchanger that transfers heat between the refrigerant and indoor air, a water heat exchanger that transfers heat from the refrigerant to water, a compressor, an outdoor expansion device, an indoor expansion device, a refrigerant management valve, a reversing valve, and various refrigerant conduits.

In some embodiments, these refrigerant conduits include, for example, a first refrigerant conduit connecting the outdoor heat exchanger to the outdoor expansion device, a second refrigerant conduit connecting the indoor heat exchanger to the indoor expansion device, a third refrigerant conduit connecting the outdoor expansion device to the indoor expansion device, and a fourth refrigerant conduit connecting a discharge port on the compressor to the water heat exchanger. Further, in a number of embodiments, these refrigerant conduits include a fifth refrigerant conduit connecting the water heat exchanger to the refrigerant management valve, a sixth refrigerant conduit connecting the refrigerant management valve to the reversing valve, a seventh refrigerant conduit connecting the reversing valve to the outdoor heat exchanger, an eighth refrigerant conduit connecting the reversing valve to the indoor heat exchanger, a ninth refrigerant conduit connecting the refrigerant management valve to the third refrigerant conduit, and a tenth refrigerant conduit connecting the reversing valve to an inlet port on the compressor, as examples.

Moreover, some embodiments further include a digital controller that includes programming instructions, for example, to manage refrigerant charge by controlling the outdoor expansion device and the indoor expansion device. Further, in some embodiments, the digital controller includes programming instructions to manage refrigerant charge during conditions under which a particular heat exchanger is not needed for transferring heat, by delivering refrigerant gas to the particular heat exchanger and driving liquid refrigerant out of the particular heat exchanger. Still further, in various embodiments, the particular heat exchanger is either the outdoor heat exchanger or the indoor heat exchanger. Even further, in a number of embodiments, the digital controller includes programming instructions to (e.g., while the refrigerant gas is in the particular heat exchanger), isolate the particular heat exchanger against additional refrigerant flowing into the particular heat exchanger. Further still, in some embodiments, the digital controller includes programming instructions to, while the particular heat exchanger is isolated against additional refrigerant flowing into the particular heat exchanger, operate the heat pump, including, for example, running the compressor and heating the water at the water heat exchanger. Even further still, in some embodiments, the digital controller further includes programming instructions to isolate the particular heat exchanger by controlling the refrigerant management valve, and to isolate the particular heat exchanger by controlling the outdoor expansion device or the indoor expansion device.

Further, in some embodiments, the third refrigerant conduit directly connects the outdoor expansion device to the indoor expansion device. Even further, in a number of embodiments, the fourth refrigerant conduit directly connects the discharge port on the compressor to the water heat exchanger. Still further, in some embodiments, the sixth refrigerant conduit directly connects the refrigerant management valve to the reversing valve. Further still, certain embodiments include all such direct connections.

In particular embodiments the heat pump further includes a refrigerant recovery valve, an eleventh refrigerant conduit connecting the sixth refrigerant conduit to the refrigerant recovery valve, and a twelfth refrigerant conduit connecting the refrigerant recovery valve to the tenth refrigerant conduit. Moreover, in certain embodiments, the heat pump includes a digital controller that includes programming instructions to manage refrigerant charge during conditions under which a particular heat exchanger is not needed for transferring heat, by opening the refrigerant recovery valve and thereby removing idle refrigerant from the particular heat exchanger through the eleventh refrigerant conduit, through the refrigerant recovery valve, and through the twelfth refrigerant conduit. Further, in various embodiments, the idle refrigerant is delivered from the particular heat exchanger to the compressor, and while the refrigerant recovery valve is open, the heat pump is operated (e.g., by the digital controller, using the programming instructions), including running the compressor and heating the water at the water heat exchanger. Further still, In a number of embodiments, the particular heat exchanger is either the outdoor heat exchanger or the indoor heat exchanger. Even further, in particular embodiments, the outdoor heat exchanger includes a ground loop.

Still other specific embodiments provide various heat pumps that alternately heat and cool a space and also heat water. In a number of embodiments, such a heat pump includes, for example, an outdoor heat exchanger that transfers heat between refrigerant and outdoor air or a heat source/sink, an indoor heat exchanger that transfers heat between the refrigerant and indoor air, a water heat exchanger that transfers heat from the refrigerant to water, a compressor that compresses the refrigerant, the compressor having an inlet port and a discharge port, various valves, and various refrigerant conduits. These valves can include, for example, a refrigerant management valve, a reversing valve that switches the heat pump between a cooling mode wherein the space is cooled by the heat pump and a heating mode wherein the space is not cooled by the heat pump, and a refrigerant recovery valve. Further, the various conduits can include for instance, a fourth refrigerant conduit directly connecting the discharge port on the compressor to the water heat exchanger, a sixth refrigerant conduit connecting the refrigerant management valve to the reversing valve, a tenth refrigerant conduit connecting the reversing valve to the inlet port on the compressor, and a refrigerant recovery conduit connecting the sixth refrigerant conduit to the tenth refrigerant conduit. In a number of embodiments, the refrigerant recovery valve is located in the refrigerant recovery conduit, for example.

In some such embodiments, the heat pump further includes a digital controller that includes programming instructions to manage refrigerant charge during conditions under which a particular heat exchanger is not needed for transferring heat, for example, by opening the refrigerant recovery valve and thereby removing idle refrigerant from the particular heat exchanger through the refrigerant recovery conduit and through the refrigerant recovery valve. In a number of embodiments, the digital controller further includes programming instructions to deliver the idle refrigerant from the particular heat exchanger to the compressor, and while the refrigerant recovery valve is open, to operate the heat pump, including running the compressor and heating the water at the water heat exchanger. Further, in a number of such embodiments, the particular heat exchanger is either the outdoor heat exchanger or the indoor heat exchanger, and in certain embodiments, the outdoor heat exchanger includes a ground loop.

Additionally, in particular embodiments, the heat pump further includes an outdoor expansion device, an indoor expansion device, and at least six of: a first refrigerant conduit connecting the outdoor heat exchanger to the outdoor expansion device, a second refrigerant conduit connecting the indoor heat exchanger to the indoor expansion device, a third refrigerant conduit connecting the outdoor expansion device to the indoor expansion device, a fifth refrigerant conduit connecting the water heat exchanger to the refrigerant management valve, a seventh refrigerant conduit connecting the reversing valve to the outdoor heat exchanger, an eighth refrigerant conduit connecting the reversing valve to the indoor heat exchanger, or a ninth refrigerant conduit connecting the refrigerant management valve to the third refrigerant conduit.

Furthermore, in various embodiments, the refrigerant management valve is a three-way valve, the reversing valve is a four-way valve, and the refrigerant recovery valve is a two-way valve, or a subcombination thereof. In a number of embodiments, in a first mode of operation, the refrigerant management valve operates to isolate the outdoor heat exchanger, and in a second mode of operation, the refrigerant management valve operates to isolate the indoor heat exchanger. Further, in a number of embodiments, the refrigerant management valve has a first position and a second position, and when the refrigerant management valve is in the first position, the heat pump uses both the outdoor heat exchanger and the indoor heat exchanger to transfer heat. Still further, in a number of embodiments, when the refrigerant management valve is in the second position, the heat pump uses only one of the outdoor heat exchanger or the indoor heat exchanger to transfer heat.

In some embodiments, in a first mode of operation, the refrigerant recovery valve opens to draw refrigerant from the outdoor heat exchanger to the inlet port on the compressor, and in a second mode of operation, the refrigerant recovery valve opens to draw refrigerant from the indoor heat exchanger to the inlet port on the compressor. Further, in some embodiments, in a first mode of operation, the heat pump heats the domestic hot water with the water heat exchanger while cooling the space with the indoor heat exchanger, including condensing the refrigerant in the water heat exchanger and managing refrigerant charge in the heat pump by removing liquid refrigerant from the outdoor heat exchanger. Even further, in some embodiments, in a second mode of operation, the heat pump heats the domestic hot water with the water heat exchanger while extracting heat from the outdoor air or from the heat source/sink with the outdoor heat exchanger without heating the space with the indoor heat exchanger and without cooling the space with the indoor heat exchanger, including condensing the refrigerant in the water heat exchanger and managing refrigerant charge in the heat pump by removing liquid refrigerant from the indoor heat exchanger.

Still further, in some embodiments, in a third mode of operation, the heat pump heats the domestic hot water with the water heat exchanger while cooling the space with the indoor heat exchanger and while rejecting heat to the outdoor air or to the heat source/sink with the outdoor heat exchanger, including desuperheating the refrigerant in the water heat exchanger and condensing the refrigerant in the outdoor heat exchanger. Even further still, in some embodiments, in a fourth mode of operation, the heat pump heats the domestic hot water with the water heat exchanger while heating the space with the indoor heat exchanger and while extracting heat from the outdoor air or from the heat source/sink with the outdoor heat exchanger, including desuperheating the refrigerant in the water heat exchanger and condensing the refrigerant in the indoor heat exchanger. In addition, various other embodiments of the invention are also described herein, and other benefits of certain embodiments may be apparent to a person of ordinary skill in the art.

DETAILED DESCRIPTION OF EXAMPLES OF EMBODIMENTS

A number of embodiments of the subject matter described herein include heat pumps that heat and cool a space (e.g., within a building) and that also heat water (e.g., domestic hot water), systems and methods of managing refrigerant charge in such heat pumps, and systems and methods for heating and cooling a space and for heating water. Certain embodiments allow such heat pumps to be operated in one or more (e.g., two) modes not otherwise available without complex and expensive refrigerant management systems, significant loss in efficiency during certain modes or operation, or a combination thereof. Particular embodiments deliver hot refrigerant gas to a particular heat exchanger of the heat pump that is not needed at the time for transferring heat, drive liquid refrigerant out of that particular heat exchanger, and then isolate the particular heat exchanger against additional refrigerant flowing into the particular heat exchanger. The heat pump is then operated while the particular heat exchanger is isolated. In some embodiments, the refrigerant charge can be adjusted during operation. Further, some embodiments remove idle refrigerant from a heat exchanger that is not needed for transferring heat by opening a refrigerant recovery valve and delivering the idle refrigerant from the heat exchanger to an inlet port on the compressor.

Figure 2:
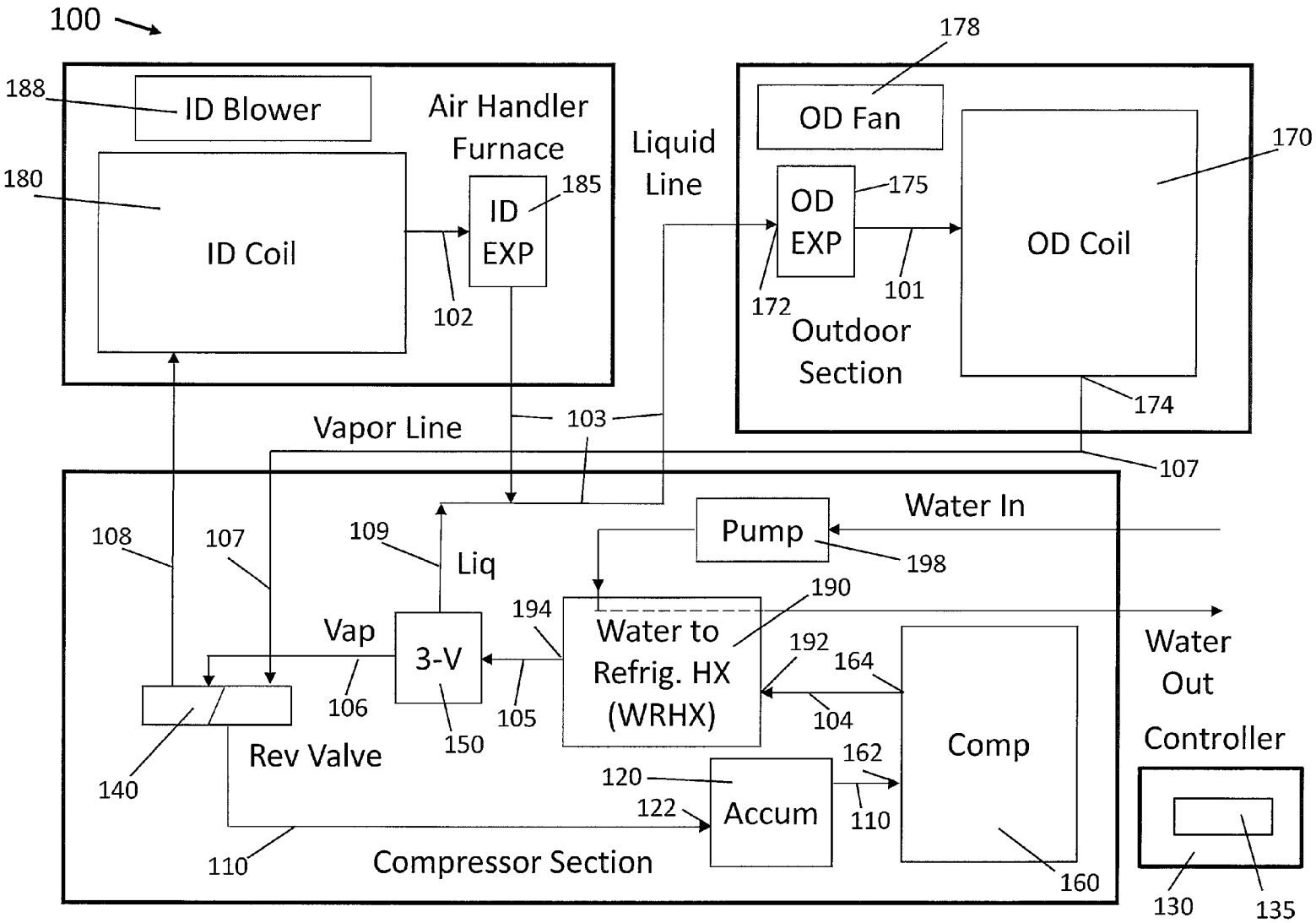
FIG. 2 is a block diagram illustrating the example of a heat pump shown in FIG. 1, except operating in a mode in which the space is neither heated nor cooled.

FIG. 1 illustrates an example of a heat pump, heat pump 100 operating in a cooling mode (i.e., cooling the space). In different modes of operation, heat pump 100 heats and cools a space (e.g., within a building) and also heats water (e.g., domestic hot water). Heat pump 100 has an improved system to manage refrigerant charge, which will be described in detail in the following paragraphs. FIG. 2 illustrates heat pump 100 operating in a mode that does not cool the space. Rather, in the mode of operation of FIG. 2, heat is extracted from the environment, in particular, from the outdoor air or from the ground. Heat pump 100 is an example of a heat pump that heats or cools a space and that also heats water. Other embodiments may differ. Use of a heat pump (e.g., 100) to heat water can be more efficient and can reduce energy cost for heating water in comparison to use of a conventional electric resistance water heater in combination with a heat pump (used just to heat and cool the space) of the same efficiency.

In the embodiment illustrated, heat pump 100 includes outdoor heat exchanger 170 that transfers heat between refrigerant and outdoor air, indoor heat exchanger 180 that transfers heat between the refrigerant and indoor air, and desuperheater or water heat exchanger 190 that transfers heat from the refrigerant to water (e.g., domestic hot water). Heat pump 100, in this embodiment, also includes compressor 160, outdoor expansion device 175, indoor expansion device 185, refrigerant management valve 150, reversing valve 140, and various refrigerant conduits. These refrigerant conduits include, in this particular embodiment, for example, first refrigerant conduit 101 connecting outdoor heat exchanger 170 to outdoor expansion device 175, second refrigerant conduit 102 connecting indoor heat exchanger 180 to indoor expansion device 185, and third refrigerant conduit 103 connecting outdoor expansion device 175 to indoor expansion device 185. Moreover, this particular embodiment includes, for instance, fourth refrigerant conduit 104 connecting discharge port 164 on compressor 160 to water heat exchanger (e.g., domestic hot water heat exchanger) 190, fifth refrigerant conduit 105 connecting water heat exchanger 190 to refrigerant management valve 150, and sixth refrigerant conduit 106 connecting refrigerant management valve 150 to reversing valve 140. Further, this particular embodiment includes seventh refrigerant conduit 107 connecting reversing valve 140 to outdoor heat exchanger 170, eighth refrigerant conduit 108 connecting reversing valve 140 to indoor heat exchanger 180, ninth refrigerant conduit 109 connecting refrigerant management valve 150 to third refrigerant conduit 103, and tenth refrigerant conduit 110 connecting reversing valve 140 to inlet port 162 on compressor 160.

A "refrigerant conduit", as used herein, forms an enclosed passageway through which refrigerant flows or can flow and can be or include one or more sections of tubing or pipe, one or more passageways through one or more other components such as fittings, valve bodies, accumulators (e.g., 120), or a combination thereof, as examples. Further, refrigerant conduits described herein as "connecting" two components provide an enclosed passageway between the two components through which refrigerant flows or can flow, at least in one or more modes of operation. Unless explicitly described otherwise, however, specifically identified refrigerant conduits described herein, connecting different components, as used herein, do not include one or more other specifically identified refrigerant conduits described herein. Moreover, refrigerant conduits described herein may differ in shape or length from what is shown on the drawings, which are not drawn to scale. Further, the terms "directly connects" and "exclusively connects" are defined further below.

The embodiment shown has two expansion devices 175 and 185. In this embodiment, in both modes of operation shown in FIGS. 1 and 2, refrigerant is delivered from refrigerant management valve 150 through refrigerant conduit 109 and is introduced to refrigerant conduit 103 between the two expansion devices 175 and 185. Other embodiments of heat pumps can function with just one expansion device, for example, performing the function of expansion device 175, performing the function of expansion device 185, or performing both such functions. For embodiments that have just one expansion device, however, where that one expansion device performs the functions of both expansion device 175 and expansion device 185, additional components may be necessary to route the refrigerant in different modes of operation. In many instances, use of two expansion devices (e.g., 175 and 185) can be less expensive, less complicated, or both, than providing additional components to route the refrigerant in different modes of operation with just one expansion device. Just one expansion device can be used, however, in embodiments of heat pumps that cool the space but do not heat the space (e.g., embodiments where a furnace, such as a gas furnace, is used to provide heat) or in embodiments that heat the space but do not cool the space, as examples.

Further, in different embodiments, heat pump 100 can be a packaged unit (e.g., for roof top installation) or a split system, with one component installed within the space (e.g., containing, among other things, indoor air coil 180 and indoor air blower or fan 188) while a second enclosed component is installed outdoors (e.g., containing, among other things, outdoor heat exchanger 170, outdoor fan 178, compressor 160, reversing valve 140, and accumulator 120) for example. In some embodiments, the hot water heater can be packaged with the heat pump, or with one component of a split heat pump, while in other embodiments, the hot water heater can be a separate component. Heat pump 100 can be a residential heat pump, for example, and can be used on a house, for instance. In other embodiments, however, heat pump 100 can be used to heat or cool (or both) another building such as a business, as another example. Some embodiments include the building.

As used herein, an "outdoor heat exchanger" is not necessarily located outdoors. In a number of embodiments, however, the "outdoor heat exchanger" exchanges heat with outdoor air. For instance, in the embodiment illustrated, outdoor heat exchanger 170 exchanges heat between the refrigerant and outdoor air moved by outdoor fan 178. But in other embodiments, the "outdoor heat exchanger" exchanges heat with a heat source/sink (e.g., other than the outdoor air), which may be located outdoors or indoors, in different embodiments. As used herein, a "heat source/sink" can act as a heat source, providing heat to the heat pump, can act as a heat sink, accepting heat rejected by the heat pump, or both. Examples of such a "heat source/sink" include the ground (e.g., a geothermal loop), soil, sand, rock, ground water, or surface water (e.g., a lake, a pond, a stream, or a river), as examples. In some embodiments, geothermal energy or heat can be used, or a solar collector or solar heat storage device can be used, for instance, as a heat source (e.g., for an outdoor heat exchanger). In still other embodiments, a compost pile or land fill can be used as a heat source (e.g., for an outdoor heat exchanger), as further examples. In some embodiments, an artificial heat source/sink, a thermal mass, or thermal reservoir can be used, which can include a phase change material, a tank of water, masonry, or concrete, as examples. Moreover, in some embodiments, a heat sink can be used that can be below outdoor ambient air temperature, such as a cooling tower, a fountain, a swimming pool, or a cooling pond, as examples. In some embodiments, more than one outdoor heat exchanger can be used, for example, one that exchanges heat with outdoor air and another that exchanges heat with a heat source/sink. Further, in some embodiments, more than one heat source/sink can be used, for instance, each with an outdoor heat exchanger. In some embodiments, for example, different heat source/sinks may be at different temperatures and one heat sink may be used to reject heat while a separate heat source may be used to obtain heat.

Water heat exchanger 190 can heat water circulated from a separate tank or water heater (e.g., electric resistance, gas, solar, geothermal, heat pump, or a combination thereof), for example, via water pump 198. In some embodiments, refrigerant delivered to water heat exchanger 190 from compressor 160 never exceeds the boiling temperature of the water, and pump 198 can be turned off when water heating is not needed or is not desired and boiling of the water in water heat exchanger 190 does not occur. Further, in some embodiments, pump 198 is a variable-speed pump (e.g., a pump driven by a variable-speed motor or a pump driven by a motor that is driven by a variable-speed drive, such as a variable-frequency drive). In some such embodiments, the speed of pump 198 can be controlled (e.g., by controller 130, via programming instructions 135, described in more detail below) to control how much heat is transferred from the refrigerant to the water in water heat exchanger 190, for example, if heat from the refrigerant is also needed to heat the space (e.g., via indoor heat exchanger 180). In other embodiments, pump 198 is a single speed pump that is cycled on and off as needed, or is a multi-speed pump, as other examples.

In some embodiments, the separate water heater (i.e., separate from water heat exchanger 190) can include special connections, fittings, or attachment points that the water is taken from or delivered to (or both) for circulation through water heat exchanger 190. In other embodiments, however, a conventional water heater can be used and existing connections thereon can be used for circulating water through water heat exchanger 190. In other embodiments, water heat exchanger 190 includes a tank (e.g., with a refrigerant coil inside, for instance, in the bottom) and a separate tank or water heater can be omitted, at least in some applications. Such embodiments, however, may lack the flexibility of being able to turn off pump 198 when water heating is not desired. In some embodiments, a refrigerant bypass can be used for this purpose. Furthermore, in still other embodiments, a different fluid other than the water that is ultimately being heated (e.g., other than the domestic hot water) is circulated through "water" heat exchanger 190. This different fluid can also be circulated through a coil located in the separate tank or water heater or through a separate heat exchanger located thereby. In such embodiments, the different fluid can be antifreeze, for example, or a mixture of water and glycol, such as ethylene glycol.

In the embodiment illustrated, refrigerant management valve 150 is a three-way valve. In other embodiments, the refrigerant management valve can be a two-way valve or multiple two-way valves, as other examples. In one alternative, for instance, refrigerant management valve 150 is replaced with a Tee and a first two-way valve is installed in refrigerant conduit 106 while a second two-way valve is installed in refrigerant conduit 109. These two (2) two-way valves are then wired so that one is open when the other is closed. In the embodiment shown, in the cooling mode of operation shown in FIG. 1, refrigerant management valve 150 allows outdoor heat exchanger 170 to be either connected in series with water heat exchanger 190 and indoor heat exchanger 180, or isolated (in combination with outdoor expansion device 175) from the remainder of heat pump 100 with water heat exchanger 190 and indoor heat exchanger 180 connected in series. Similarly, in the embodiment shown in the mode of operation shown in FIG. 2, refrigerant management valve 150 allows indoor heat exchanger 180 to be either connected in series with water heat exchanger 190 and outdoor heat exchanger 170, or isolated (in combination with indoor expansion device 185) from the remainder of heat pump 100 with water heat exchanger 190 and outdoor heat exchanger 170 connected in series.

Further, in the embodiment illustrated, outdoor expansion device 175 and indoor expansion device 185 are expansion valves, and in particular, are electronic expansion valves or EXV's. In this particular embodiment, indoor expansion device 185 operates in the cooling mode shown in FIG. 1 to control the refrigerant superheat at outlet 184 of indoor heat exchanger 180, for instance, at accumulator 120 (e.g., at inlet 122 of accumulator 120), or between outlet 184 and inlet port 162 of compressor 160. Further, in this particular embodiment, outdoor expansion device 175 operates in the dedicated water heating mode shown in FIG. 2 to control the refrigerant superheat at outlet 174 of outdoor heat exchanger 170, for instance, at accumulator 120 (e.g., at inlet 122 of accumulator 120), or between outlet 174 and inlet port 162 of compressor 160. In a number of embodiments, expansion devices 175 and 185 have an integral check valve therein, arranged in parallel with the orifice of the expansion device, to allow refrigerant to exit the corresponding heat exchanger without having to pass through the orifice of that expansion device.

In other embodiments, other types of expansion devices may be used other than electronic expansion valves. Further, in some embodiments, expansion devices can be used that are not electronic. Examples include thermal expansion valves, or TXVs. In a number of embodiments, a separate valve (e.g., automatic, electric, or electronic) is provided in series with the (e.g., non-electronic) expansion device, as another example. Further, in some embodiments, outdoor expansion device 175 is not necessarily located outdoors or in an outdoor enclosure, indoor expansion device 185 is not necessarily located indoors (e.g., in an air handler of a split system), or both. Indoor expansion device 185, however, reduces the pressure of the refrigerant when, or just before, the refrigerant enters indoor heat exchanger 180 (e.g., when indoor heat exchanger 180 is being used as an evaporator, for instance, as shown in FIG. 1). Similarly, outdoor expansion device 175 reduces the pressure of the refrigerant when, or just before, the refrigerant enters outdoor heat exchanger 170 (e.g., when outdoor heat exchanger 170 is being used as an evaporator, for instance, as shown in FIG. 2).

In this particular embodiment, heat pump 100 also includes digital controller 130 that includes, for instance, programming instructions 135 to perform certain acts or functions. In this embodiment, digital controller 130 includes a processor, memory, and various connections to control different components of heat pump 100, among other things. In a number of embodiments, digital controller includes a user interface, a display, a keypad, a keyboard, an input device, connections to various sensors, connections to external networks or to a master control system, or a combination thereof, as examples. Digital controller can be wired to various components of heat pump 100 when heat pump 100 is installed, for instance, with control wiring, power wiring, or both. Further, instructions 135 can include software running on digital controller 130, stored in the memory thereof, or both, for example. In some embodiments, for example, instructions 135 can include, for instance, instructions to manage refrigerant charge by controlling refrigerant management valve 150, instructions to manage refrigerant charge by controlling outdoor expansion device 175, instructions to manage refrigerant charge by controlling indoor expansion device 185, instructions to control other control valves or solenoid valves, or a combination thereof.

Further, in some embodiments, digital controller 130 can include, for example, programming instructions (e.g., 135) to manage refrigerant charge during conditions under which a particular heat exchanger is not needed for transferring heat, by delivering refrigerant gas to the particular heat exchanger and driving liquid refrigerant out of the particular heat exchanger. In certain embodiments, for example, digital controller 130 may determine, or may act upon a determination made when controller 130 was programmed, that energy consumption can be reduced, operating cost can be reduced, or efficiency can be improved, by not using the particular heat exchanger for transferring heat under the circumstances existing at that time (e.g., relative demand for heating or cooling and for hot water). As used herein, this is an example of the particular heat exchanger not being "needed for transferring heat". As used herein, in this context, being deemed to not be beneficial is sufficient to be "not needed".

In various embodiments, the particular heat exchanger that is not needed for transferring heat can be either outdoor heat exchanger 170 or indoor heat exchanger 180, for example, depending on the mode of operation of heat pump 100. Moreover, in some embodiments, digital controller 130 can include programming instructions (e.g., 135) to isolate the particular heat exchanger against additional refrigerant flowing into the particular heat exchanger, for instance, while the refrigerant gas is in the particular heat exchanger. Further, in some embodiments, digital controller 130 can include programming instructions to operate heat pump 100, including running compressor 160, heating the water at water heat exchanger 190, or both, for example, while the particular heat exchanger is isolated against additional refrigerant flowing into the particular heat exchanger. Even further, in particular embodiments, digital controller 130 includes programming instructions (e.g., 135) to perform at least one of the following acts: isolate the particular heat exchanger by controlling refrigerant management valve 150, isolate the particular heat exchanger by controlling outdoor expansion device 175 or indoor expansion device 185, or both.

Certain embodiments include various methods, for example, of managing refrigerant charge in a heat pump (e.g., 100) that heats or cools a space and also heats water (e.g., domestic hot water). Such a heat pump can include, for example, an outdoor heat exchanger (e.g., 170) that transfers heat between refrigerant and outdoor air or a heat source/sink, as examples, an indoor heat exchanger (e.g., 180) that transfers heat between the refrigerant and indoor air, a water heat exchanger (e.g., 190) that transfers heat from the refrigerant to water, a compressor (e.g., 160), and at least one expansion device (e.g., 175, 185, or both). In this context, as used herein, the phrase "that transfers heat" means during at least one mode of operation (e.g., at least one of modes one to six or acts 401 to 406 described below) of the heat pump (e.g., 100), not necessarily while a particular act of a particular method (e.g., 300 described below) is being performed. Various embodiments of methods can include, for example, at least certain acts, which can be performed in the order indicated, one or more other orders, or any order, in some embodiments, except where a particular order is required, as examples.

Figure 3:
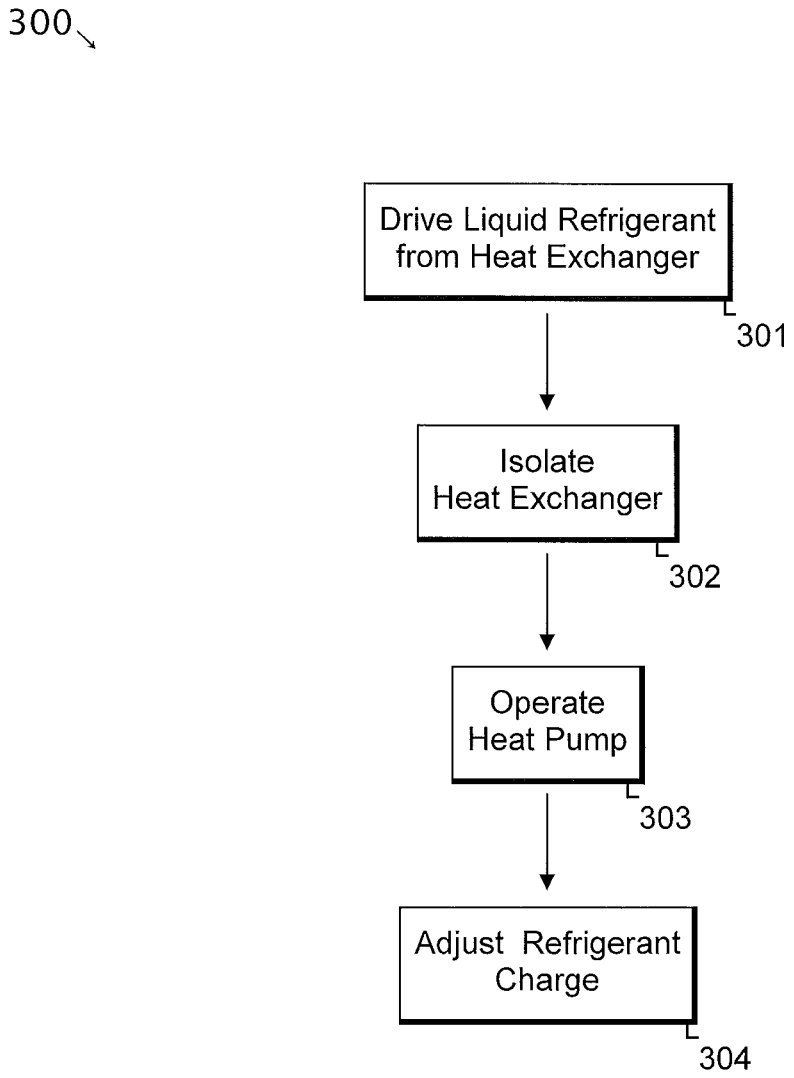
FIG. 3 is a flow chart illustrating an example of a method of managing refrigerant charge in a heat pump that heats and cools a space and that also heats water.

FIG. 3 illustrates a particular example of a method, method 300. In the example of method 300, the acts include, for example, during conditions under which a particular heat exchanger of the heat pump (e.g., 100) is not needed for transferring heat, act 301 of driving liquid refrigerant from the particular heat exchanger. In a number of embodiments, act 301 can include delivering refrigerant gas to the particular heat exchanger and driving liquid refrigerant out of the particular heat exchanger, for example, through at least one expansion device (e.g., outdoor expansion device 175 or indoor expansion device 185). In the embodiment shown in FIGS. 1 and 2, for example, compressor 160 can be run to deliver refrigerant gas to the particular heat exchanger in act 301. Refrigerant management valve 150 can be positioned to deliver the refrigerant through refrigerant conduits 105 and 106 to reversing valve 140, which can be positioned to deliver the refrigerant gas to the appropriate "particular" heat exchanger, which depends on the mode of operation.

In some embodiments, the fan associated with the particular heat exchanger (e.g., fan 178 or 188) can be off (e.g., remain off or be turned off) in act 301, or at least part of act 301, to let the particular heat exchanger get hot and liquid refrigerant therein to be pushed out or evaporate. In particular embodiments, for example, the particular heat exchanger fan is left off if the suction superheat is above a required low limit. In a number of embodiments, the temperature and pressure will continue to rise in act 301, at least while the particular heat exchanger fan is off. How quickly the temperature and pressure will rise (e.g., in act 301) can depend on the speed of the compressor (e.g., 160), in various embodiments. In a number of embodiments, compressor (e.g., 160) discharge temperature, discharge pressure, or both, can be monitored (e.g., at compressor discharge port 164, within refrigerant conduit 104, or at water heat exchanger inlet 192, as examples). In some embodiments, pressure can be monitored further downstream, for example, at water heat exchanger outlet 194, or at refrigerant conduit 105, for instance. Such monitoring can be performed continuously or every 5 seconds, as examples, to make sure these parameters remain below the discharge temperature limit, pressure limit, or both, for instance, specified by the compressor manufacturer.

In this example, the refrigerant gas displaces and drives the liquid refrigerant out of the particular heat exchanger. In the embodiment shown, liquid refrigerant will be driven (e.g., in act 301) to the low pressure side (i.e., through the expansion device that being used to reduce pressure in the mode of operation taking place). The liquid refrigerant will first flood the evaporator, in this embodiment, and then may flood the accumulator (e.g., 120). The accumulator should be properly sized for this purpose. Liquid refrigerant flooding back to the compressor (e.g., 160) should typically be avoided. In a number of embodiments, refrigerant superheat is continuously monitored, for example, or sampled at regular intervals, for instance, every 5 seconds, for example, at outlet 174 or 184 of the heat exchanger that is acting as an evaporator, at accumulator 120 (e.g., at inlet 122 of accumulator 120), or between outlet 174 or 184 and inlet port 162 of compressor 160. If the refrigerant superheat is above a certain temperature threshold, (e.g., 5 degrees F.), the evaporator fan (e.g., 178 or 188, depending on which heat exchanger 170 or 180 is acting as the evaporator) is decelerated or turned off, in particular embodiments, to allow more liquid to be stored in the evaporator. If the refrigerant superheat is below a particular temperature threshold, however, in some embodiments, the evaporator fan (e.g., 178 or 188, depending on which heat exchanger 170 or 180 is acting as the evaporator) is accelerated or turned on to prevent liquid refrigerant from flooding the accumulator.

Another act in method 300 is act 302, which includes, for instance, while the refrigerant gas (e.g., delivered in act 301) is in the particular heat exchanger, isolating the particular heat exchanger against additional refrigerant flowing into the particular heat exchanger. As used herein "isolating the particular heat exchanger against additional refrigerant flowing into the heat exchanger" means blocking all refrigerant conduits to the heat exchanger so that refrigerant cannot flow into the heat exchanger from the rest of the heat pump (e.g., 100), for instance, by closing or changing one or more valves. In this example, act 302 is performed after act 301. After the particular heat exchanger is isolated in act 302, the temperature of the particular heat exchanger and pressure therein will usually drop. Since the particular heat exchanger is isolated, however, refrigerant from other components of heat pump 100 (e.g., other than the particular heat exchanger) cannot flow into the particular heat exchanger, which prevents loss of refrigerant charge from heat pump 100 (excluding the particular heat exchanger).

In a number of embodiments, not all of the liquid refrigerant is driven out of the particular heat exchanger in act 301. Some liquid can remain, in particular embodiments. In certain embodiments, the amount of liquid refrigerant that remains in the particular heat exchanger (e.g., at the end of act 301 or when act 302 is performed) is controlled to provide the proper amount of refrigerant charge in heat pump 100 excluding the particular heat exchanger. Such control may be based on pressure, for example, within the system (i.e., heat pump 100). In some embodiments, other parameters may be measured as well for this determination (e.g., when to end act 301 or initiate act 302), such as temperature at one or more locations in the system.

In some embodiments, act 301 of driving liquid refrigerant out of the particular heat exchanger includes monitoring compressor discharge temperature, for example. Further, in some embodiments, act 301 of driving liquid refrigerant out of the particular heat exchanger includes monitoring compressor discharge pressure, for instance. Even further, in some embodiments, act 301 of driving liquid refrigerant out of the particular heat exchanger includes monitoring duration of the act of driving liquid refrigerant out of the particular heat exchanger. Some embodiments monitor just one such parameter, other embodiments monitor two such parameters, and still other embodiments monitor all three of these parameters. Certain embodiments monitor other parameters as well. In various embodiments, act 301 of driving liquid refrigerant out of the particular heat exchanger is terminated when the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration, as examples.

In particular embodiments, act 301 of driving liquid refrigerant out of the particular heat exchanger includes monitoring compressor discharge temperature, compressor discharge pressure, and duration of the act of driving liquid refrigerant out of the particular heat exchanger, and act 301 of driving liquid refrigerant out of the particular heat exchanger is terminated when the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration, whichever occurs first. In this context, as used herein, the term "exceeds" means reaches or exceeds. Further, as used herein, compressor discharge temperature, compressor discharge pressure, or both, can be measured, for example, (e.g., anywhere) between the compressor discharge and the next heat exchanger or expansion device that the refrigerant passes through. For example, in the embodiments of FIGS. 1 and 2, compressor discharge temperature, compressor discharge pressure, or both, can be measured, for example, at compressor discharge port 164, refrigerant conduit 104, or at inlet 192 of water heat exchanger 190, as examples. In other embodiments, on the other hand, substantially all or all of the liquid refrigerant is driven out of the particular heat exchanger in act 301. In some embodiments, some refrigerant can be let back in to the particular heat exchanger, however, to adjust the refrigerant charge (e.g., in act 304, described in more detail below).

In the embodiment illustrated, method 300 also includes, for example, while the particular heat exchanger is isolated (e.g., as initiated in act 302) against additional refrigerant flowing into the particular heat exchanger, act 303 of operating the heat pump (e.g., 100). Act 303 can include running compressor 160, for example. In a number of embodiments, act 303 can also include heating water at heat exchanger 190, as another example. In a number of embodiments, act 303 begins when act 302 takes place.

In various embodiments the "particular heat exchanger" can be the outdoor heat exchanger (e.g., 170), the indoor heat exchanger (e.g., 180), or the water heat exchanger (e.g., 190). In the embodiment illustrated in FIGS. 1 and 2, however the "particular heat exchanger" can only be outdoor heat exchanger 170 or indoor heat exchanger 180 because sufficient valves and refrigeration conduit are not included in this particular embodiment to isolate (e.g., in act 302) water heat exchanger 190. Other embodiments may include such valves and conduit, as another example, to isolate the water heat exchanger (e.g., in the sixth mode of operation or act 406, described below). In the particular embodiment illustrated in FIGS. 1 and 2, the "particular heat exchanger" can be the outdoor heat exchanger (e.g., 170) or the indoor heat exchanger (e.g., 180), depending on the mode of operation. In certain embodiments, in a first mode of operation, the "particular heat exchanger" is the outdoor heat exchanger (e.g., 170), in a second mode of operation or the "particular heat exchanger" is the indoor heat exchanger (e.g., 180). Further, in some embodiments, the heat pump operates in the first mode of operation but not the second mode of operation, in some embodiments, the heat pump operates in the second mode of operation but not the first mode of operation, and in some embodiments, the heat pump operates in the first mode of operation under certain conditions and in the second mode of operation under other conditions (e.g., as determined by controller 130).

In certain embodiments, for example (e.g., in the first mode of operation), the particular heat exchanger is the outdoor heat exchanger (e.g., 170), and the act of delivering refrigerant gas to the particular heat exchanger and driving liquid refrigerant out of the particular heat exchanger (e.g., act 301) includes, for instance, during conditions under which the outdoor heat exchanger (e.g., 170) is not needed for transferring heat (e.g., as determined by digital controller 130 of heat pump 100), delivering refrigerant gas to the outdoor heat exchanger and driving liquid refrigerant out of the outdoor heat exchanger. Moreover, in such embodiments, the act of isolating the particular heat exchanger against additional refrigerant flowing into the particular heat exchanger (e.g., act 302) includes, for instance, while the refrigerant gas is in the outdoor heat exchanger (e.g., 170), isolating the outdoor heat exchanger against additional refrigerant flowing into the outdoor heat exchanger (e.g., by actuating refrigerant management valve 150, by closing expansion device 175, or both). Further, in a number of such embodiments, the act of operating the heat pump (e.g., 303), including running the compressor (e.g., 160) includes, while the outdoor heat exchanger is isolated (e.g., in act 302) against additional refrigerant flowing into the outdoor heat exchanger, operating the heat pump (e.g., 100), including running the compressor (e.g., 160), heating the water at the water heat exchanger (e.g., 190), and cooling the space using the indoor heat exchanger (e.g., 180), for example.

In various embodiments (e.g., in a second mode of operation), the particular heat exchanger is the indoor heat exchanger (e.g., 180), and the act of delivering refrigerant gas to the particular heat exchanger and driving liquid refrigerant out of the particular heat exchanger (e.g., act 301) includes, for example, during conditions under which the indoor heat exchanger is not needed for transferring heat (e.g., as determined by controller 130), delivering refrigerant gas to the indoor heat exchanger (e.g., 180) and driving liquid refrigerant out of the indoor heat exchanger. Moreover, in a number of embodiments, the act of isolating the particular heat exchanger against additional refrigerant flowing into the particular heat exchanger includes, for instance, while the refrigerant gas is in the indoor heat exchanger, isolating the indoor heat exchanger (e.g., 180) against additional refrigerant flowing into the indoor heat exchanger (e.g., act 302, for instance, by actuating refrigerant management valve 150, by closing expansion device 185, or both). Further, in a number of such embodiments, the act of operating the heat pump (e.g., 303), including running the compressor (e.g., 160) includes, while the indoor heat exchanger is isolated against additional refrigerant flowing into the indoor heat exchanger, operating the heat pump, including running the compressor (e.g., 160), heating the water at the water heat exchanger (e.g., 190), and extracting heat from outdoor air or from a heat source/sink, as examples, using the outdoor heat exchanger (e.g., 170), for instance.

In different embodiments, the method can include the first mode of operation, the second mode of operation, or both, or can include at least one of the first mode of operation or the second mode of operation, as another example. In some embodiments, the method includes just the first mode of operation. In other embodiments, the method includes just the second mode of operation. And in still other embodiments, the method includes both the first mode of operation and the second mode of operation, as another example.

In a number of embodiments, act 302 of isolating the particular heat exchanger against additional refrigerant flowing into the particular heat exchanger includes closing a particular expansion device or electronic expansion valve that is connected to the particular heat exchanger, for instance, with a first refrigerant conduit. Moreover, in particular embodiments, act 303 of operating the heat pump includes keeping the particular expansion device or electronic expansion valve closed for at least a majority of act 303 of operating the heat pump (e.g., 100). In different embodiments, the "particular electronic expansion device" can be outdoor expansion device 175 or indoor expansion device 185, as examples. Moreover, in certain embodiments, in a first mode of operation, the "particular electronic expansion device" is outdoor expansion device 175, and in a second mode of operation, the "particular electronic expansion device" is indoor expansion device 185, as another example.

Further, in some embodiments or modes of operation in which the "particular electronic expansion device" is outdoor expansion device 175, the "first refrigerant conduit" is first refrigerant conduit 101 connecting outdoor heat exchanger 170 to outdoor expansion device 175. Further still, in some embodiments or modes of operation in which the "particular electronic expansion device" is indoor expansion device 185, the "first refrigerant conduit" (i.e., in the context of this example) is second refrigerant conduit 102 connecting indoor heat exchanger 180 to outdoor expansion device 185. Even further still, in some embodiments, even in the context of this example, the particular expansion device or electronic expansion valve can be opened for a short time (e.g., in act 304) to let refrigerant into the particular heat exchanger to adjust the refrigerant charge in the system (e.g., in heat pump 100 excluding the particular heat exchanger). In a number of embodiments, the particular expansion device or electronic expansion valve can be opened (e.g., in act 304) for a minority or small fraction (e.g., less than 10, 5, 3, 2, or 1 percent) of the duration of act 303 of operating the heat pump, as examples. Act 304 can be performed, in particular embodiments, to let refrigerant into the particular heat exchanger to adjust the refrigerant charge in the active system (e.g., in heat pump 100 excluding the particular heat exchanger and certain refrigerant conduits connected to the particular heat exchanger). In a number of embodiments, act 304 may be controlled (e.g., by controller 130) based on pressure, for example, within the system (i.e., within heat pump 100). In some embodiments, other parameters may be measured as well for this determination (e.g., to control act 304), such as temperature at one or more locations in the system. In other embodiments, on the other hand, refrigerant charge may be controlled in another way.

In certain embodiments, act 302 of isolating the particular heat exchanger against additional refrigerant flowing into the particular heat exchanger includes actuating a refrigerant management valve (e.g., 150). In the particular embodiment shown, refrigerant management valve 150 is located, for example, in a refrigerant conduit (e.g., 105 and 106, as shown) that connects water heat exchanger 190 to reversing valve 140 that is used to switch heat pump 100 between a heating mode, in which the heat pump heats the space, and a cooling mode, in which the heat pump cools the space. In the embodiment shown, in either the first mode (FIG. 1) or the second mode (FIG. 2), act 302 is accomplished by switching refrigerant management valve 150 so that refrigerant entering refrigerant management valve 150 from refrigerant conduit 105 is directed into refrigerant conduit 109 rather than into refrigerant conduit 106. When act 302 takes place, or prior to act 302 taking place, the particular expansion device (e.g., 175 or 185, depending on the mode of operation) is closed (e.g., under the direction of controller 130). The particular fan (e.g., 178 or 188 depending on the mode) can be turned off or remain off, during act 303, and water pump 198 is turned on, in the embodiment illustrated. In embodiments and modes of operation in which the water heat exchanger is the particular heat exchanger, however, the water pump can be off during act 303. Compressor 160 is set to the desired speed (in embodiments where compressor 160 is a variable speed compressor or has a variable speed drive) in act 303 (e.g., under the control of controller 130), and the evaporator fan (e.g., whichever fan 178 or 188 is not the "particular" fan) is turned on or set to the desired speed (e.g., by controller 130) in the embodiment illustrated.

Moreover, in the particular embodiment illustrated, act 302 of isolating the particular heat exchanger against additional refrigerant flowing into the particular heat exchanger includes closing the particular expansion device or electronic expansion valve (e.g., 175 or 185) and actuating the refrigerant management valve (e.g., 150). In the particular embodiment illustrated, both the appropriate expansion device and the refrigerant management valve are actuated to isolate the heat exchanger. Which expansion device or valve is actuated depends on which heat exchanger (e.g., 170 or 180) is being isolated (i.e., which heat exchanger is the "particular heat exchanger") in the particular mode of operation sought (e.g., the first mode of operation or the second mode of operation described herein).

Still referring to FIG. 3, as mentioned, some embodiments include, for example, act 304 of adjusting the refrigerant charge. In certain embodiments, as illustrated, act 304 of adjusting the refrigerant charge takes place after act 302 of isolating the particular heat exchanger against additional refrigerant flowing into the particular heat exchanger. In a number of embodiments, however, act 304 of adjusting the refrigerant charge takes place during act 303 of operating the heat pump (e.g., 100). In some embodiments, act 304 of adjusting the refrigerant charge includes using the particular electronic expansion valve (e.g., expansion device 175 or 185) to let refrigerant into the particular heat exchanger. In other embodiments, on the other hand, act 304 of adjusting the refrigerant charge includes using the refrigerant management valve (e.g., 150) to let refrigerant into the particular heat exchanger. Moreover, in particular embodiments, act 304 of adjusting the refrigerant charge includes using both one of the particular electronic expansion valves (e.g., expansion device 175 or 185) and the refrigerant management valve (e.g., 150) to let refrigerant into the particular heat exchanger. In many embodiments, however, use of one valve is sufficient for act 304. In various embodiments, act 304 of adjusting the refrigerant charge includes using at least one of the particular electronic expansion valve (e.g., expansion device 175 or 185) or the refrigerant management valve (e.g., 150) to let refrigerant into the particular heat exchanger. In some embodiments, in act 304, refrigerant management valve 150 is opened and held open for 0.1, 0.25, 0.5, 1, 2, 3, 4, or 5 seconds, as examples, or within a range from 0.1 to 10 seconds, 0.25 to 5 seconds, 0.5 to 4 seconds, or 1 to 3 seconds, as examples, before being closed. Further, in some embodiments, in act 304, electronic expansion valve or expansion device 175 or 185 is opened and held open for 1, 2, 3, 4, 5, 6, 7, 8, 9, 10, 12, 15, 20, or 30 seconds, as examples, or within a range from 1 to 30 seconds, 2 to 20 seconds, 4 to 15 seconds, or 8 to 12 seconds, as examples, before being closed. In certain embodiments, in act 304, electronic expansion valve or expansion device 175 or 185 is opened to the default condition or the Y-signal is applied, for example.

In certain embodiments, act 304 of adjusting the refrigerant charge includes monitoring refrigerant subcooling at the water heat exchanger outlet (e.g., 194), for example, and letting refrigerant into the particular heat exchanger, for instance, if the subcooling at the water heat exchanger outlet (e.g., 194) exceeds a predetermined subcooling threshold. In this context, the "water heat exchanger outlet" means anywhere from the water heat exchanger (e.g., 190) to the next heat exchanger or expansion device that the refrigerant passes through after leaving the water heat exchanger (e.g., indoor expansion device 185 in the mode shown in FIG. 1 or outdoor expansion device 175 in the mode shown in FIG. 2, whichever of these two expansion valves is not associated with the heat exchanger that is acting as the particular heat exchanger). Thus, in this context of monitoring refrigerant subcooling for act 304, the "water heat exchanger outlet" includes refrigerant conduits 105, 109, and part of 103 from 109 to indoor expansion device 185, in the mode shown in FIG. 1, as well as water heat exchanger 190, refrigerant management valve 150, and inlet 182 of indoor expansion device 185. (In this example, inlet 182 of indoor expansion device 185 is an inlet in the mode shown in FIG. 1 but is an outlet in the mode shown in FIG. 2.) Similarly, in this context, the "water heat exchanger outlet" includes refrigerant conduits 105, 109, and part of 103 from 109 to outdoor expansion device 175, in the mode shown in FIG. 2, as well as water heat exchanger 190, refrigerant management valve 150, and inlet 172 of outdoor expansion device 175. (In this example, inlet 172 of outdoor expansion device 175 is an inlet in the mode shown in FIG. 2 but is an outlet in the mode shown in FIG. 1.)

In some embodiments, the predetermined subcooling threshold is 15 degrees F., for example. For instance, in some embodiments, if the subcooling is above 15 degrees F., the refrigerant charge is adjusted (e.g., in act 304) and if the subcooling is below 15 degrees F., the refrigerant charge is not adjusted (act 304 is not performed). In other embodiments, on the other hand, the predetermined subcooling threshold is between 5 and 30 degrees F., between 10 and 20 degrees F., between 12 and 18 degrees F., or between 13 and 17 degrees F., as examples. In particular embodiments, once act 304 is performed or the refrigerant charge is adjusted, a minimum stabilization time is allowed to pass before act 304 is repeated or the refrigerant charge is adjusted again. This minimum stabilization time can be 60 seconds, for example. In other embodiments, the stabilization time can be between 20 and 180 seconds, between 30 and 120 seconds, or between 45 and 90 seconds, as examples. In a number of embodiments, the same criteria is applied whether the indoor heat exchanger (e.g., 180) or the outdoor heat exchanger (e.g., 170) is acting as the isolated or "particular" heat exchanger.

In some embodiments, act 304 is not initiated until at least a certain amount of time after act 303 is started (e.g., after act 302). This amount of time may be 1, 2, 3, 4, 5, 7, or 10 minutes, as examples, or within a range from 1 to 10 minutes, from 2 to 7 minutes, from 2 to 5 minutes, or from 3 to 4 minutes, as examples. In a number of embodiments, in act 304, if the subcooling is too high, the particular expansion device (e.g., electronic expansion valve, for instance, 175 or 185, depending on the mode of operation) is opened or the refrigerant management valve 150 is opened (e.g., briefly) to allow some refrigerant to flow back into the particular heat exchanger. This event can be rather short to prevent too much refrigerant from flowing back into the particular heat exchanger, and can last less than a minute, 10, 5, 3, 2, or 1 seconds, less than such a number of seconds, or a fraction of a second, as examples, after which the particular expansion device or the refrigerant management valve is closed. Generally, use of an electronic expansion valve for act 304 provides for a gradual and controlled change in refrigerant charge and resulting subcooling. In other embodiments, however, a refrigerant management valve (e.g., 150) can be used for act 304, for example, in embodiments that do not have an electronic expansion valve (e.g., in embodiments that have a TXV). In some embodiments, after a period of time (e.g., 1, 2, 3, 4, 5, 7, or 10 minutes, as examples) act 304 is repeated if the subcooling is still too high.

In some embodiments, during conditions under which a certain heat exchanger of the heat pump (e.g., 100) is used as an evaporator, act 301 of driving liquid refrigerant out of the particular heat exchanger includes monitoring refrigerant superheat, for example, between the evaporator and the compressor (e.g., 160). In this example, the "evaporator" is one of the heat exchangers of heat pump 100 other than the "particular heat exchanger". In some embodiments and modes of operation, for instance, as shown in FIG. 1, the evaporator is indoor heat exchanger 180 and the particular heat exchanger is outdoor heat exchanger 170. Further, in some embodiments and modes of operation, for example, as shown in FIG. 2, the evaporator is outdoor heat exchanger 170 and the particular heat exchanger is indoor heat exchanger 180. Moreover, in this context, "between the evaporator and the compressor" includes, in the example of FIG. 1, indoor heat exchanger outlet 184, refrigerant conduit 108, reversing valve 140, refrigerant conduit 110, accumulator 120, and compressor inlet port 162. Furthermore, in this context, "between the evaporator and the compressor" includes, in the example of FIG. 2, outdoor heat exchanger outlet 174, refrigerant conduit 107, reversing valve 140, refrigerant conduit 110, accumulator 120, and compressor inlet port 162.

In a number of embodiments, if the refrigerant superheat between the evaporator and the compressor (e.g., 160) is less than a predetermined bottom superheat threshold, then the method (e.g., 300) includes (e.g., within act 301) starting or accelerating an evaporator fan that blows air through the evaporator. In the example of FIG. 1, for instance, indoor air fan 188 is the evaporator fan. In the example of FIG. 2, on the other hand, outdoor air fan 178 is the evaporator fan. In some embodiments, the evaporator and evaporator fans (as well as the particular heat exchanger) are different components in different modes of operation. Even further, in a number of embodiments, if the refrigerant superheat between the evaporator and the compressor (e.g., 160) exceeds a predetermined top superheat threshold, then the method (e.g., 300) includes (e.g., within act 301) stopping or decelerating the evaporator fan that blows air through the evaporator.

In some embodiments and modes of operation, the evaporator fan is a single speed fan (i.e., a fan having a single-speed motor that is either on or off, without a variable-speed drive). In a number of such embodiments, if the refrigerant superheat between the evaporator and the compressor is less than the predetermined bottom superheat threshold, then the evaporator fan that blows air through the evaporator is started (e.g., from a stop). Further, in such embodiments and modes of operation, if the refrigerant superheat between the evaporator and the compressor exceeds the predetermined top superheat threshold, then the evaporator fan that blows air through the evaporator is stopped (e.g., is turned off). Further, in some embodiments and modes of operation, the evaporator fan is a multiple speed or variable speed fan (i.e., a fan having a multiple-speed motor or a variable speed drive). In a number of such embodiments, if the refrigerant superheat between the evaporator and the compressor is less than the predetermined bottom superheat threshold, then the evaporator fan that blows air through the evaporator is accelerated (e.g., increased in speed, either from a stop or from a lower speed). Further, in such embodiments and modes of operation, if the refrigerant superheat between the evaporator and the compressor exceeds the predetermined top superheat threshold, then the evaporator fan that blows air through the evaporator is decelerated (e.g., reduced in speed or turned off).

Figure 4:
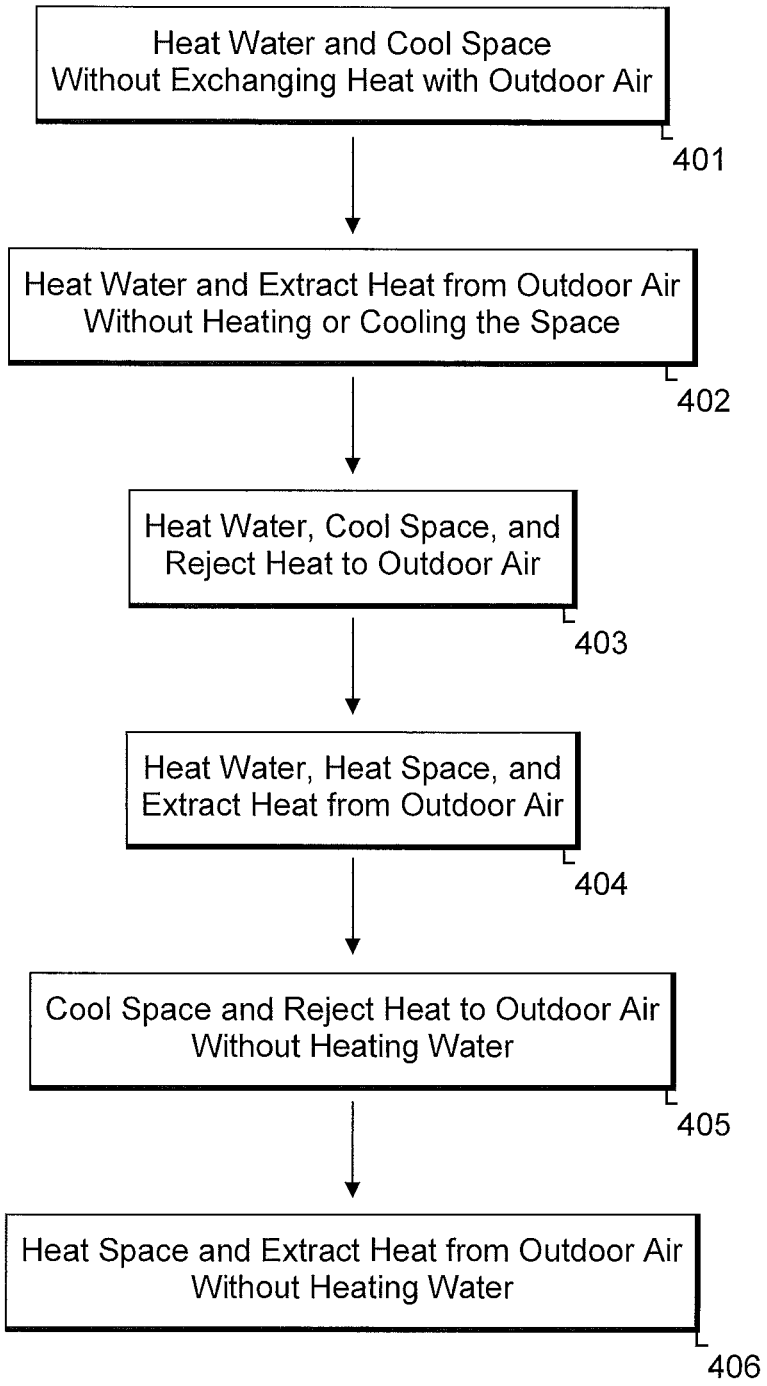
FIG. 4 is a flow chart illustrating an example of a method of heating and cooling a space and for also heating water, illustrating multiple modes of operation, some of which can involve particular acts to manage the refrigerant charge.

Certain embodiments include various methods of heating and cooling a space and also for heating water, for example, domestic hot water. Such a method can include, for example, in any order, at least certain acts, which can be performed in different modes of operation. FIG. 4 illustrates an example of such a method, method 400, which includes various acts or modes of operation. In certain acts of FIG. 4, outdoor air is identified. In particular, embodiments, however, a heat source/sink, other than outdoor air, such as the ground or ground water, can be used instead of, or in addition to, outdoor air. In the embodiment illustrated, method 400 includes, in a first mode of operation, act 401 of heating water, for instance, domestic hot water, while cooling the space without rejecting heat to outdoor air or to a heat source/sink and without extracting heat from the outdoor air or from the heat source/sink, as examples. Heat pump 100 is performing act 401 in FIG. 1, for example. In this first mode of operation (e.g., act 401 in FIG. 4), in the embodiment shown in FIG. 1, during act 303 of method 300 shown in FIG. 3, indoor heat exchanger 180 acts as the evaporator and water heat exchanger 190 acts as the condenser. Thus, heat pump 100 moves thermal energy from the space to the water (e.g., domestic hot water), cooling the space while heating the water.

Further, method 400 also includes, in the embodiment shown, in a second mode of operation, act 402, of heating water (e.g., domestic hot water) while extracting heat from the outdoor air (or from a heat source/sink), without heating the space and without cooling the space. Heat pump 100 is performing act 402 in FIG. 2, for example. In this second mode of operation (e.g., act 402 in FIG. 4), in the embodiment shown in FIG. 2, during act 303 of method 300 shown in FIG. 3, outdoor heat exchanger 170 acts as the evaporator and water heat exchanger 190 acts as the condenser. Thus, heat pump 100 moves thermal energy from the outdoor air or from the heat source/sink, as examples, to the water (e.g., domestic hot water), cooling the environment, for instance, while heating the water.

The first mode of operation, act 401, is a combined cooling (of the space) and water heating mode, and the second mode of operation, act 402, is a dedicated water heating mode. Both the first and the second modes of operation (e.g., acts 401 and 402) are water heating modes in which all of the heat moved by heat pump 100 in these modes (except for minor losses) is delivered to the water (e.g., via water heat exchanger 190). These modes of operation provide for higher capacity water heating than other possible modes of operation, since in these modes, the water heat exchanger (e.g., 190) can fully condense the refrigerant to a subcooled liquid rather than just desuperheating the refrigerant. This can be a significant advantage, particularly under conditions when demand for heating of the space is not present and demand for cooling of the space is not especially high. Since these two modes of operation do not use one of either the indoor heat exchanger (e.g., 180) or the outdoor heat exchanger (e.g., 170), changing to either of these modes of operation (i.e., the first mode or the second mode of operation) will result in the accumulation of liquid refrigerant in the unused heat exchanger and insufficient refrigerant charge in the heat pump (e.g., 100), unless refrigerant management action is taken such as method 300 shown in FIG. 3 and described herein, other methods described herein, or other more elaborate and more costly solutions. Thus, use of method 300, for example, or other methods described herein, at least in the first and second modes of operation, provides for greater system flexibility under different operating conditions.

Further still, method 400 includes, in the embodiment illustrated, in a third mode of operation, act 403 of heating water (e.g., domestic hot water) while cooling the space and while rejecting heat to the outdoor air or to the heat source/sink, as examples. In this third mode of operation (e.g., act 403 in FIG. 4), indoor heat exchanger 180 acts as the evaporator and water heat exchanger 190 acts as a desuperheater. Outdoor heat exchanger 170 acts as the condenser. Thus, heat pump 100 moves thermal energy from the space to the water (e.g., domestic hot water) and to the outdoor air, in this embodiment, cooling the space while heating the water and heating the environment. The third mode of operation, act 403, is appropriate for circumstances under which demand for cooling of the space is high or demand for heating of the water is insufficiently high to use all of the heat removed from the space to meet the cooling demand. Further, in some embodiments, in one or more modes of operation, where water heat exchanger 190 acts as a desuperheater, some condensation of the refrigerant can take place in water heat exchanger 190. Even further, in some embodiments, in one or more modes of operation, where a heat exchanger acts as a condenser, some desuperheating of the refrigerant can take place in that heat exchanger.

Moreover, method 400 includes, in this embodiment, in a fourth mode of operation, act 404 of heating the water while heating the space and while extracting heat from the outdoor air (or from a heat source/sink, as another example). In this fourth mode of operation (e.g., act 404 in FIG. 4), indoor heat exchanger 180 acts as the condenser and water heat exchanger 190 acts as a desuperheater. Outdoor heat exchanger 170 acts as the evaporator. Thus, heat pump 100 moves thermal energy from the outdoor air, for instance, to the space and to the water (e.g., domestic hot water) and heating the space while heating the water and cooling the environment. The fourth mode of operation, act 404, is appropriate for circumstances under which demand exists for both heating of the space and for heating of the water, but neither demand is so high as to overshadow the other.

Even further still, method 400 includes, in the embodiment shown, in a fifth mode of operation, act 405 of cooling the space while rejecting heat to the outdoor air (or to a heat source/sink, as another example), without heating water (e.g., domestic hot water). In this fifth mode of operation, water pump 198 is turned off. Further, in this fifth mode of operation (e.g., act 405 in FIG. 4), indoor heat exchanger 180 acts as the evaporator and outdoor heat exchanger 170 acts as the condenser. Thus, heat pump 100 moves thermal energy from the space to the outdoor air, cooling the space while heating the environment. In this mode of operation, in the embodiment illustrated in FIG. 1. for example, water heat exchanger 190 acts simply as a refrigerant conduit. In other embodiments, a refrigerant bypass can route the refrigerant around the water heat exchanger (e.g., 190), as another example. Such a refrigerant bypass can include at least one bypass valve (e.g., a three-way valve or a two-way valve), suitable refrigerant conduit, and fittings, such as Tee's, for instance. In embodiments where the water heat exchanger (e.g., 190), can act as the "particular heat exchanger", there may be two bypass valves (e.g., two three-way valves), or the bypass valve may be a four-way valve, as other examples. In some embodiments, such a refrigerant bypass can reduce refrigerant pressure drop in comparison with routing the refrigerant through the water heat exchanger (e.g., 190) in act 405. The fifth mode of operation, act 405, is appropriate for circumstances under which demand exists for cooling of the space but there is no demand for heating of the water (e.g., the water is already at a maximum temperature).

Still further, in a sixth mode of operation, act 406 of heating the space while extracting heat from the outdoor air (or from a heat source/sink, as another example), also without heating water (e.g., domestic hot water). In this sixth mode of operation, water pump 198 is turned off. Further, in this sixth mode of operation (e.g., act 406 in FIG. 4), indoor heat exchanger 180 acts as the condenser and outdoor heat exchanger 170 acts as the evaporator. Thus, heat pump 100 moves thermal energy from the outdoor air, for instance, to the space, cooling the environment while heating the space. In this mode of operation, in the embodiment illustrated in FIG. 2. for example, water heat exchanger 190 acts simply as a refrigerant conduit. In other embodiments, a refrigerant bypass can route the refrigerant around the water heat exchanger (e.g., 190), as another example. Such a refrigerant bypass can include at least one bypass valve (e.g., a three-way valve or a two-way valve), suitable refrigerant conduit, and fittings, such as Tee's, for instance. In embodiments where the water heat exchanger (e.g., 190), can act as the "particular heat exchanger", there may be two bypass valves (e.g., two three-way valves), or the bypass valve may be a four-way valve, as other examples. In some embodiments, such a refrigerant bypass can reduce refrigerant pressure drop in comparison with routing the refrigerant through the water heat exchanger (e.g., 190) in act 406. The sixth mode of operation, act 406, is appropriate for circumstances under which demand for heating of the space is high and demand for heating of the water is insufficiently low that it is desirable to use all of the heat removed from the environment to heat the space rather than heating the water. This mode is also appropriate for circumstances under which demand exists for heating of the space (even if not high) and there is no demand for heating of the water (e.g., the water is already at a maximum temperature).

In various embodiments, it is a significant aspect that all four of the acts 401, 402, 403, and 404 are accomplished by the same heat pump. Further, in some embodiments, it is a significant aspect that all six of the acts 401, 402, 403, 404, 405, and 406 can be and are accomplished by the same heat pump. In a number of embodiments, these different acts or modes of operation are accomplished at different times, for example, when different demands exist for heating, cooling, or both. Further, in various embodiments, the physical configuration of the heat pump makes these different acts or modes possible and practical in the same heat pump. Further, in a number of embodiments, the physical configuration of the heat pump makes these different acts or modes cost effective.

In some embodiments, pump 198 is a variable-speed or multi-speed pump and pump 198 is operated (e.g., by controller 130 via programming instructions 135) at a lower speed when heat exchanger 190 is being used (e.g., only) to desuperheat the refrigerant (e.g., in act 403 or 404), and pump 198 is operated at a higher speed when heat exchanger 190 is being used to (e.g., fully) condense (e.g., in addition to desuperheat, in some embodiments) the refrigerant (e.g., in act 401 or 402). In various embodiments, this higher speed (e.g., of act 401, 402, or both) is 1.5, 1.75, 2, 2.25, 2.5, 3, 3.5, 4, or 5 times faster, or within a range between two of these values, as examples, than the lower speed (e.g., of act 403, 404, or both). For example, in some embodiments, pump 198 is operated at a lower speed when heat exchanger 190 is being used to heat water while the space is also being heated by the refrigerant (e.g., in act 404).

When pump 198 is being operated at a lower speed, the water is heated to a higher temperature, in a number of embodiments, but due to the much lower flow rate of the water, the total amount of heat removed from the refrigerant can be much less than when pump 198 is operated at a higher speed. In some embodiments, the speed of pump 198 is varied over a range of speeds (e.g., in acts 403, 404, or both) depending on the demand or relative demand for hot water, space conditioning, or both. In certain embodiments, however, demand or relative demand for hot water is given a priority over demand for space conditioning, at least when a hot water temperature is below a minimum temperature threshold. Further, in a number of embodiments, pump 198 is turned off during act 405 and 406 (e.g., when the water temperature in the tank reaches a maximum temperature threshold). When pump 198 is off, the water in heat exchanger 190 can become even hotter (e.g., than the maximum temperature threshold), in a number of embodiments, but remain below the boiling point of the water. In addition, when pump 198 is off, the water in heat exchanger 190 is not circulated to the hot water tank, so water in the hot water tank is not heated (e.g., significantly) and heat is not absorbed by the water other than an initial (e.g., negligible) amount of heat to heat the water in heat exchanger 190.

In a number of embodiments, the HVAC unit controller (e.g., 130) can select the mode of operation (e.g., from FIG. 4), for instance, by controlling reversing valve 140, by controlling refrigerant management valve 150, by controlling water pump 198, by controlling expansion devices 175 and 185, by controlling fans 178 and 188, or a combination thereof, as examples. In various embodiments, these different modes of operation can be performed in any order depending, for example, on demand for heating or cooling of the space and for heating of the water. Further, a number of embodiments include or perform fewer than all of the modes of operation or acts of method 400 shown in FIG. 4 and described herein. For example, some embodiments omit or do not require act 405, act 406, or both. In a number of embodiments, method 300, shown in FIG. 3, for instance, in one of the embodiments described herein, can be performed in act 401, act 402, or both, for example. Moreover, in certain embodiments, method 300, shown in FIG. 3, for instance, in one of the embodiments described herein, can be performed in act 405, act 406, or both, for another example (e.g., in embodiments in which the water heat exchanger can be isolated or can be the "particular heat exchanger"). As described, however, in embodiments where method 300 is performed in act 405, act 406, or both, additional valves, refrigerant conduit, or both, may be required over what is shown in FIGS. 1 and 2 to isolate and bypass water heat exchanger 190. In other embodiments, however, act 405, 406, or both, can be performed (e.g., with the apparatus shown in FIGS. 1 and 2) by turning off water pump 198 (e.g., circulating domestic hot water).

In a number of embodiments, in at least one of the first mode or the second mode, the method (e.g., 400) includes managing the refrigerant charge, for example, in accordance with one of the methods described herein (e.g., 300). In certain embodiments, the first mode of operation, the second mode of operation, or both, may be as previously described, for instance. Even further, in a number of embodiments, during the method (e.g., 400) of heating and cooling the space, the rejecting of heat to the outdoor air or to a heat source/sink (e.g., in act 403 or 405) is accomplished using the outdoor heat exchanger (e.g., 170), the extracting of heat from the outdoor air or from the heat source/sink (e.g., in act 402, 404, or 406) is accomplished using the outdoor heat exchanger (e.g., 170), the heating of water (e.g., the domestic hot water) is accomplished using the water heat exchanger (e.g., 190), or a combination thereof, as examples. Even further still, in various embodiments, the cooling of the space (e.g., in act 401, 403, or 405) is accomplished using the indoor heat exchanger (e.g., 180), the heating the space (e.g., in act 404 or 406) is accomplished using the indoor heat exchanger (e.g., 180), or both.

Further embodiments include various heat pumps (e.g., 100) that heat or cool a space and that also heat water. Such a heat pump can include, for example, an outdoor heat exchanger (e.g., 170) that transfers heat between refrigerant and outdoor air or a heat source/sink, an indoor heat exchanger (e.g., 180) that transfers heat between the refrigerant and indoor air, and a water heat exchanger (e.g., 190) that transfers heat from the refrigerant to water, such as domestic hot water. Further, such embodiments can include, as further examples, a compressor (e.g., 160), at least one expansion device (e.g., 175, 185, or both), and a digital controller (e.g., 130), for instance. Moreover, in a number of embodiments, the digital controller can include, for example, programming instructions (e.g., 135) to manage refrigerant charge, for instance, in accordance with a method described herein.

Various methods include one or more acts of manufacturing, obtaining or providing certain structure described herein, as other examples. Examples include an act of manufacturing, obtaining or providing a heat pump (e.g., 100) that heats and cools a space (e.g., within a building) and that also heats water (e.g., domestic hot water). A number of embodiments include an act of manufacturing, obtaining or providing an improved system to manage refrigerant charge or a heat pump having such a system. Certain embodiments include one or more acts of manufacturing, obtaining or providing an outdoor heat exchanger (e.g., 170) that transfers heat between refrigerant and outdoor air or a heat source/sink, manufacturing, obtaining or providing an indoor heat exchanger (e.g., 180) that transfers heat between the refrigerant and indoor air, and manufacturing, obtaining or providing a water heat exchanger (e.g., a domestic hot water heat exchanger, for instance, 190) that transfers heat from the refrigerant to water. Further, some embodiments include one or more acts of manufacturing, obtaining or providing a compressor (e.g., 160), manufacturing, obtaining or providing an outdoor expansion device (e.g., 175), manufacturing, obtaining or providing an indoor expansion device (e.g., 185), manufacturing, obtaining or providing a refrigerant management valve (e.g., 150), manufacturing, obtaining or providing a reversing valve (e.g., 140), manufacturing, obtaining or providing various refrigerant conduits, or a combination thereof, as examples.

Further still, a number of embodiments include one or more acts of manufacturing, obtaining or providing a first refrigerant conduit (e.g., 101) connecting an outdoor heat exchanger (e.g., 170) to an outdoor expansion device (e.g., 175), manufacturing, obtaining or providing a second refrigerant conduit (e.g., 102) connecting an indoor heat exchanger (e.g., 180) to an indoor expansion device (e.g., 185), manufacturing, obtaining or providing a third refrigerant conduit (e.g., 103) connecting the outdoor expansion device (e.g., 175) to the indoor expansion device (e.g., 185), or a combination thereof, for example. Moreover, particular embodiments include, for instance, one or more of acts of manufacturing, obtaining or providing a fourth refrigerant conduit (e.g., 104) connecting a discharge port (e.g., 164) on a compressor (e.g., 160) to a water heat exchanger or domestic hot water heat exchanger (e.g., 190), manufacturing, obtaining or providing a fifth refrigerant conduit (e.g., 105) connecting the water heat exchanger or domestic hot water heat exchanger (e.g., 190) to a refrigerant management valve (e.g., 150), manufacturing, obtaining or providing a sixth refrigerant conduit (e.g., 106) connecting the refrigerant management valve (e.g., 150) to a reversing valve (e.g., 140), or a combination thereof. Further, some methods include one or more of the acts of manufacturing, obtaining or providing a seventh refrigerant conduit (e.g., 107) connecting the reversing valve (e.g., 140) to the outdoor heat exchanger (e.g., 170), manufacturing, obtaining or providing an eighth refrigerant conduit (e.g., 108) connecting the reversing valve (e.g., 140) to the indoor heat exchanger (e.g., 180), manufacturing, obtaining or providing a ninth refrigerant conduit (e.g., 109) connecting the refrigerant management valve (e.g., 150) to a refrigerant conduit, for instance, the third refrigerant conduit (e.g., 103), manufacturing, obtaining or providing a tenth refrigerant conduit (e.g., 110 connecting the reversing valve (e.g., 140) to an inlet port (e.g., 162) on the compressor (e.g., 160), or a combination thereof, for example.

Figure 5:
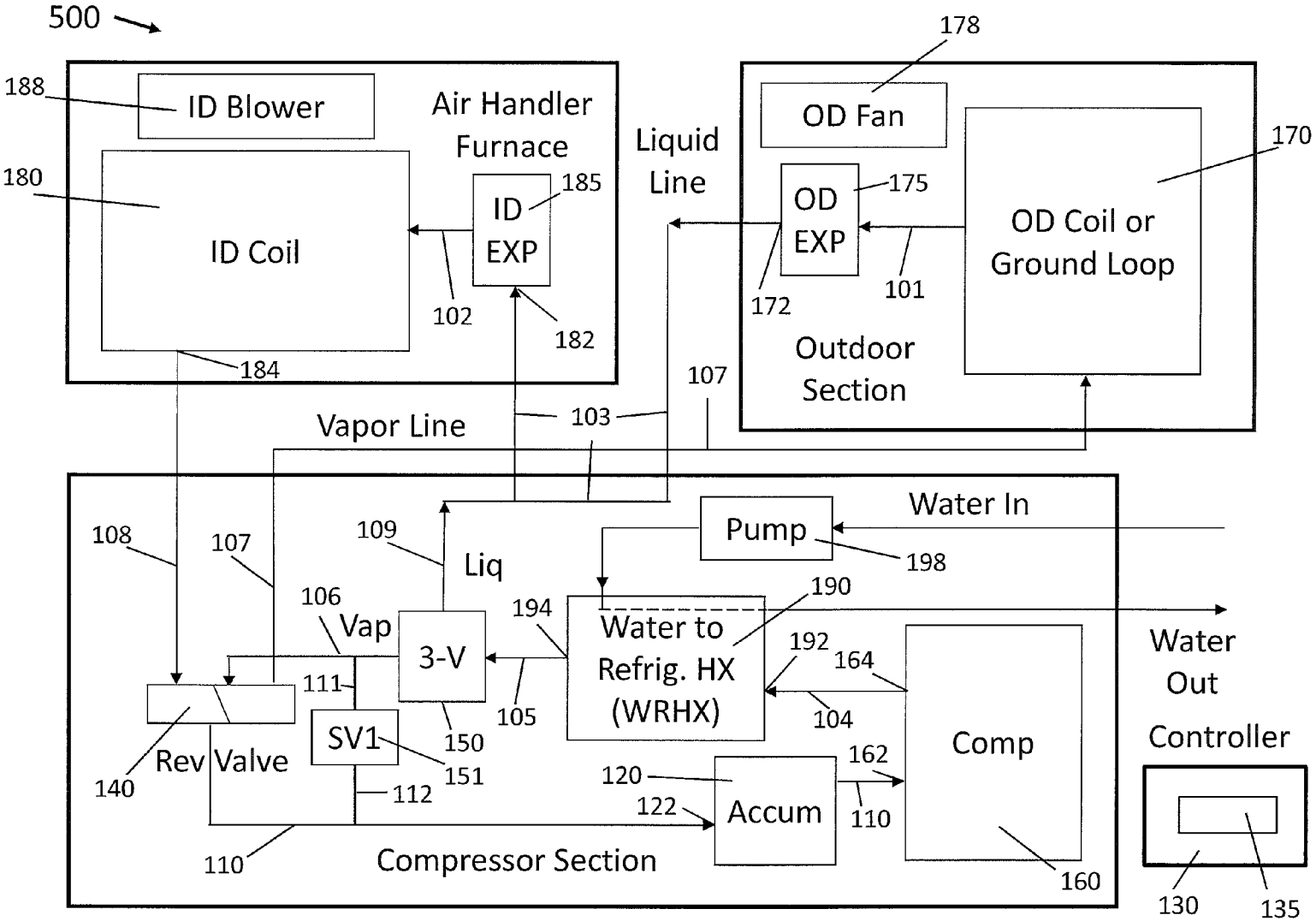
FIG. 5 is a block diagram illustrating an example of a heat pump operating in a cooling mode (i.e., cooling the space)
Figure 6:
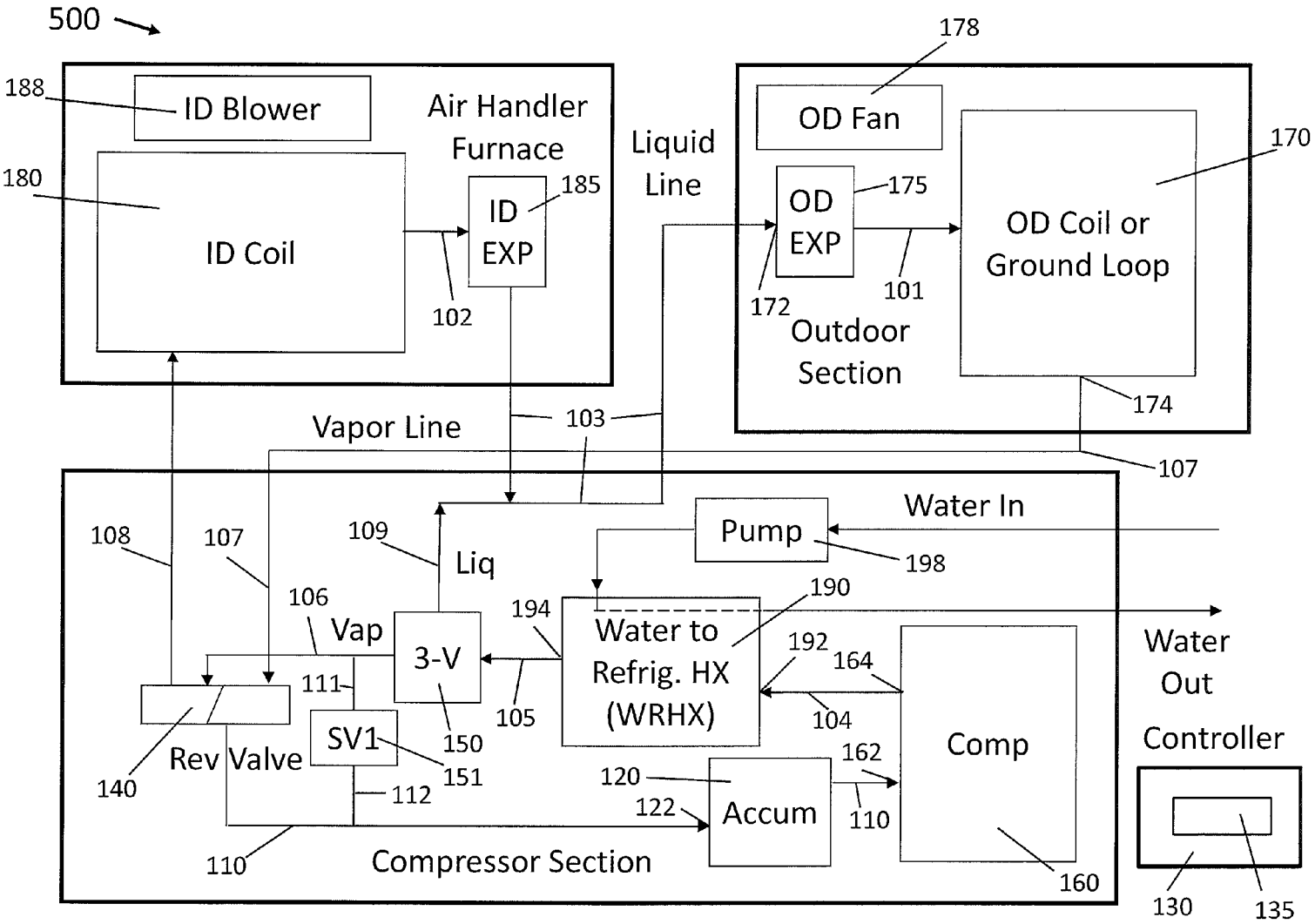
FIG. 6 is a block diagram illustrating the example of a heat pump shown in FIG. 5, except operating in a mode in which the space is neither heated nor cooled.

FIGS. 5 and 6 illustrate further embodiments that include a refrigerant recovery valve (e.g., 151). In a number of embodiments, the refrigerant recovery valve opens to remove idle (e.g., liquid) refrigerant from the particular heat exchanger (i.e., that is not being used to exchange heat) to manage refrigerant charge in the heat pump (e.g., in act 401, 402, or both shown in FIG. 4). In some embodiments, the refrigerant recovery valve is opened to remove refrigerant from the particular heat exchanger, for example, that has leaked into the particular heat exchanger through the reversing valve, through the refrigerant management valve, through one or more expansion valves, through one or more check valves that are parallel to the one or more expansion valves, or a combination thereof. Further, in a number of embodiments, the refrigerant recovery valve is opened during operation of the heat pump to optimize, for example, refrigerant charge in the heat pump, for instance, when one or more operating conditions has changed, for example, when water temperature, outdoor air temperature, space temperature, demand for hot water, or demand for space heating or cooling has changed.

Further still, in particular embodiments, the refrigerant recovery valve is opened, once the particular heat exchanger has been isolated against additional refrigerant flowing into the particular heat exchanger (e.g., in act 302 shown in FIG. 3), to remove refrigerant from the particular heat exchanger, rather than performing the act (e.g., 301) of delivering hot refrigerant gas to the particular heat exchanger to drive the liquid refrigerant out of the particular heat exchanger. In embodiments that do not perform the act (e.g., 301) of delivering hot refrigerant gas to the particular heat exchanger to drive the liquid refrigerant out of the particular heat exchanger, however, the refrigerant recovery valve (e.g., 151) the refrigerant management conduit (e.g., 111 and 112), or a combination thereof, may need to be larger to remove refrigerant from the unused or "particular" heat exchanger more quickly in order to obtain a desirable refrigerant charge in the active system of the heat pump within a desirable amount of time.

In some embodiments, incorporation of the act (e.g., 301) of delivering hot refrigerant gas to the particular heat exchanger to drive the liquid refrigerant out of the particular heat exchanger obtains a desirable refrigerant charge in the active system of the heat pump more quickly, with a smaller refrigerant recovery valve (e.g., 151), with a smaller refrigerant recovery conduit (e.g., 111 and 112), or a combination thereof. In a number of embodiments, however, inclusion of a refrigerant recovery valve (e.g., 151) and refrigerant recovery conduit (e.g., 111 and 112), for example, allows the appropriate refrigerant charge in the active system of the heat pump to be maintained, adjusted, or optimized, for example, while the heat pump is operating (e.g., in act 303) without interrupting the operation of the heat pump to perform the act (e.g., 301) of delivering hot refrigerant gas to the particular heat exchanger to drive the liquid refrigerant out of the particular heat exchanger.

In various embodiments, when the refrigerant recovery valve (e.g., 151) is open, the particular heat exchanger is connected, through the refrigerant recovery valve, to the suction side of the compressor (e.g., inlet port 162 of compressor 160). In a number of embodiments, the refrigerant recovery valve connects the unused coil or heat exchanger to the suction side of the active (e.g., full-condensing) water heating system, and when the refrigerant recovery valve is opened, refrigerant in the unused heat exchanger is sucked into the active system (e.g., the heat pump minus the unused or "particular" heat exchanger) to make up refrigerant charge losses. In different embodiments, the refrigerant recovery valve allows for shortening or eliminating of the act of delivering hot refrigerant gas to the unused heat exchanger to drive the liquid refrigerant out of the unused heat exchanger. Moreover, in various embodiments, the refrigerant conduits, valves, and connections are arranged such that a single refrigerant recovery valve (e.g., 151) can recover refrigerant from, at different times (e.g., modes of operation 401 and 402), both the indoor heat exchanger (e.g., 180) and the outdoor heat exchanger (e.g., 190), depending on which heat exchanger is being used to transfer heat.

FIGS. 5 and 6 illustrate a further example of a heat pump that heats or cools a space and also heats water. FIG. 5 illustrates heat pump 500 operating in a cooling mode (i.e., cooling the space, for instance, act 401). FIG. 6, in contrast to FIG. 5, illustrates heat pump 500 operating in a mode that does not cool the space (e.g., act 402). Rather, in the mode of operation of FIG. 6, heat is extracted from the environment, in particular, from the outdoor air or from the ground. Heat pump 500 can be similar to heat pump 100 described above, except as described herein. Further, many of the components of heat pump 500 can be the same as corresponding components of heat pump 100, and use the same reference numbers in the figures and description herein.

In the embodiment illustrated, heat pump 500 includes outdoor heat exchanger 170 that transfers heat between refrigerant and outdoor air or a heat source/sink, indoor heat exchanger 180 that transfers heat between the refrigerant and indoor air, and water heat exchanger 190 that transfers heat from the refrigerant to water (e.g., domestic hot water). Further, heat pump 500 includes compressor 160, outdoor expansion device 175, indoor expansion device 185 (various embodiments include at least one expansion device), refrigerant management valve 150, reversing valve 140, and various refrigerant conduits.

Specifically, in the embodiment shown, these refrigerant conduits include first refrigerant conduit 101 connecting outdoor heat exchanger 170 to outdoor expansion device 175, second refrigerant conduit 102 connecting indoor heat exchanger 180 to indoor expansion device 185, third refrigerant conduit 103 connecting outdoor expansion device 175 to indoor expansion device 185, and fourth refrigerant conduit 104 connecting discharge port 164 on compressor 160 to water heat exchanger 190. Further, in the embodiment depicted, these refrigerant conduits include, fifth refrigerant conduit 105 connecting water heat exchanger 190 to refrigerant management valve 150, sixth refrigerant conduit 106 connecting refrigerant management valve 150 to reversing valve 140, and seventh refrigerant conduit 107 connecting reversing valve 140 to outdoor heat exchanger 170. Further still, in the embodiment shown, these refrigerant conduits include, eighth refrigerant conduit 108 connecting reversing valve 140 to indoor heat exchanger 180, ninth refrigerant conduit 109 connecting refrigerant management valve 150 to third refrigerant conduit 103, and tenth refrigerant conduit 110 connecting reversing valve 140 to inlet port 162 on compressor 160.

In some embodiments, conduit 109 can be short and conduit 103 can extend close to or completely to refrigerant management valve 150. In some embodiments, conduit 109 is essentially a connection (e.g., a tee connection) of conduit 103 to refrigerant management valve 150, but as used herein, such a connection is still considered to be a conduit. Similar configurations are permissible for other conduits that are described as connecting to a different named conduit herein, provided the other conduit does not contain a valve or any other component other than the passageway of the conduit itself that would preclude such a connection or result in a different circuit. In other words, a refrigerant conduit, as used herein, does not necessarily have a particular length, provided the refrigerant conduit connects the components identified. Further, conduits described herein that connect to another conduit can connect to either an end or a midpoint of the other conduit, unless indicated otherwise or other components preclude such a connection.

In various embodiments, a heat pump (e.g., 500) includes a digital controller (e.g., 130), that includes, in a number of embodiments, programming instructions (e.g., 135) to manage refrigerant charge, for example, by controlling (e.g., closing, when appropriate, for instance, in act 302 shown in FIG. 3) at least one expansion device or valve, for example, the outdoor expansion device (e.g., 175), the indoor expansion device (e.g., 185), or both. Further, in particular embodiments, such a heat pump (e.g., 500) further includes a digital controller (e.g., 130) having programming instructions (e.g., 135) to manage refrigerant charge during conditions under which a particular heat exchanger is not needed for transferring heat, by delivering refrigerant gas to the particular heat exchanger and driving liquid refrigerant out of the particular heat exchanger (e.g., instructions to perform act 301 shown in FIG. 3). In different embodiments, or in different modes of operation of the same heat pump, as examples, the particular heat exchanger can be either the outdoor heat exchanger (e.g., 170) or the indoor heat exchanger (e.g., 180). Further, in some embodiments, the digital controller (e.g., 130) can have programming instructions (e.g., 135) to, while the refrigerant gas is in the particular heat exchanger, isolate the particular heat exchanger (e.g., act 302), for example, against additional refrigerant flowing into the particular heat exchanger, and while the particular heat exchanger is isolated against additional refrigerant flowing into the particular heat exchanger, to operate the heat pump (e.g., 500), including running the compressor (e.g., 160) and heating the water at the water heat exchanger (e.g., 190). In certain embodiments, the digital controller (e.g., 130) further includes programming instructions (e.g., 135) to isolate the particular heat exchanger by controlling the refrigerant management valve (e.g., 150), and to isolate the particular heat exchanger (e.g., in act 302) by controlling the outdoor expansion device (e.g., 175) or the indoor expansion device (e.g., 185) (e.g., depending on which heat exchanger is being used to transfer heat).

In the embodiment illustrated in FIGS. 1, 2, 5 and 6, third refrigerant conduit 103 directly connects outdoor expansion device 175 to indoor expansion device 185. As used herein, "directly connects", when referring to refrigerant conduits, means that the conduit connects the two components indicated without an electrically operated valve located within that conduit between the ends of the conduit. Further, in the embodiment shown, fourth refrigerant conduit 104 directly connects compressor 160, or specifically discharge port 164 on compressor 160, to water heat exchanger 190 (i.e., to water heat exchanger inlet 192 of water heat exchanger 190). Further still, in the embodiment shown, fourth refrigerant conduit 104 exclusively connects discharge port 164 on compressor 160 to water heat exchanger 190. As used herein, "exclusively connects", when referring to refrigerant conduits, means connects without any branches off of the refrigerant conduit. An example of a branch, as used herein, is a tee connection, where one refrigerant conduit connects with a tee to another refrigerant conduit. For example, in the embodiment illustrated, conduit 109 is a branch off of conduit 103, and, as used herein, conduit 103 does not exclusively connect outdoor expansion device 175 to indoor expansion device 185. Further, as used herein, a branch can be at the end of a conduit, provided the branch is fluidly connected to the conduit at the end of the conduit without passing through either component of the two components indicated that the refrigerant conduit is stated herein to connect.

Even further, in the embodiment shown in FIGS. 1, 2, 5, and 6, sixth refrigerant conduit 106 directly connects refrigerant management valve 150 to reversing valve 140. Even further still, in the embodiment shown in FIGS. 1 and 2, sixth refrigerant conduit 106 exclusively connects refrigerant management valve 150 to reversing valve 140. In the embodiment shown in FIGS. 5 and 6, however, sixth refrigerant conduit 106 does not exclusively connect refrigerant management valve 150 to reversing valve 140, because refrigerant conduit 111 branches (e.g., tees) off from refrigerant conduit 106. Similarly, in the embodiment shown in FIGS. 1, 2, 5, and 6, tenth refrigerant conduit 110 directly connects reversing valve 140 to inlet port 162 on compressor 160. Even further still, in the embodiment shown in FIGS. 1 and 2, tenth refrigerant conduit 110 exclusively connects reversing valve 140 to inlet port 162 on compressor 160. As used herein, the accumulator 120 in tenth refrigerant conduit 110 is considered to be part of refrigerant conduit 110. In the embodiment shown in FIGS. 5 and 6, however, tenth refrigerant conduit 110 does not exclusively connect reversing valve 140 to inlet port 162 on compressor 160, because refrigerant conduit 112 branches (e.g., tees) off from refrigerant conduit 110.

In various embodiments, the third refrigerant conduit directly connects the outdoor expansion device to the indoor expansion device, the fourth refrigerant conduit directly connects the discharge port on the compressor to the water heat exchanger, and the sixth refrigerant conduit directly connects the refrigerant management valve to the reversing valve. Further, in the embodiment illustrated in FIGS. 1, 2, 5, and 6, first refrigerant conduit 101 directly connects and exclusively connects outdoor heat exchanger 170 to outdoor expansion device 175, second refrigerant conduit 102 directly connects and exclusively connects indoor heat exchanger 180 to indoor expansion device 185, and fifth refrigerant conduit 105 directly connects and exclusively connects water heat exchanger 190 to refrigerant management valve 150. Even further, in the embodiment shown in FIGS. 1, 2, 5, and 6, seventh refrigerant conduit 107 directly connects and exclusively connects reversing valve 140 to outdoor heat exchanger 170, eighth refrigerant conduit 108 directly connects and exclusively connects reversing valve 140 to indoor heat exchanger 180, and ninth refrigerant conduit 109 directly connects and exclusively connects refrigerant management valve 150 to third refrigerant conduit 103.

In various embodiments, the heat pump (e.g., 500) further includes a refrigerant recovery conduit connecting the sixth refrigerant conduit (e.g., 106) to the tenth refrigerant conduit (e.g., 110). Further, a number of embodiments include a refrigerant recovery valve (e.g., 151) located in the refrigerant recovery conduit. In various embodiments, a refrigerant recovery valve, a refrigerant recovery conduit, or both, delivers refrigerant from the unused heat exchanger to the active system at the compressor inlet. FIGS. 5 and 6 illustrate an example. In the embodiment illustrated, heat pump 500 includes refrigerant recovery valve SV1 or 151, eleventh refrigerant conduit 111 connecting sixth refrigerant conduit 106 to refrigerant recovery valve 151, and twelfth refrigerant conduit 112 connecting refrigerant recovery valve 151 to tenth refrigerant conduit 110. Other embodiments can include a subcombination of these components. In a number of embodiments, refrigerant recovery valve 151 is a two-way solenoid valve, for example. In various embodiments, refrigerant recovery valve 151 is a valve controlled by an electronic board that opens and closes the refrigerant path (e.g., from refrigerant conduit 111 to refrigerant conduit 112) automatically (e.g., under the control of controller 130). In some embodiments, refrigerant recovery valve 151 is (e.g., except when opening or closing) held either fully open or fully closed, and refrigerant recovery valve 151, refrigerant conduit 111 twelfth refrigerant conduit 112, or a combination thereof, is sized to provide the appropriate amount of flow. In other embodiments, refrigerant recovery valve 151 can be a throttling valve that is opened sufficiently to provide the appropriate amount of flow, and is routinely held in such a partially open position.

In some embodiments, the refrigerant recovery conduit (e.g., refrigerant conduit 111, refrigerant recovery valve 151, refrigerant conduit 112, or a combination thereof) includes an internal dimension (e.g., a diameter) that provides a refrigerant flow rate through the refrigerant recovery conduit that is less than one tenth of a rated refrigerant flow rate of the compressor (e.g., 160) at a rated pressure of the compressor. In other embodiments, as other examples, the refrigerant recovery conduit includes an internal dimension that provides a refrigerant flow rate through the refrigerant recovery conduit that is less than one quarter, one fifth, one eighth, one $20^{th}$, one $30^{th}$ one $50^{th}$, one $75^{th}$, one $100^{th}$, one $150^{th}$, one $200^{th}$, one $300^{th}$, one $500^{th}$, $1000^{th}$, one $2000^{th}$, one $3000^{th}$, one $5000^{th}$, or one $10{,}000^{th}$ of the rated refrigerant flow rate of the compressor at the rated pressure of the compressor. Such an internal dimension can be, for example, the inside dimension (e.g., inside diameter) of an orifice or of a capillary tube, as examples. In some embodiments, the refrigerant recovery valve (e.g., 151) is omitted and this internal dimension is sized fairly small such that flow through the refrigerant recovery conduit occurs at all times and is small enough so as to be tolerable (e.g., negligible) even when not needed. Use of a refrigerant recovery valve (e.g., 151), however, can provide control over the refrigerant charge (e.g., in act 401, 402, or both) that is faster, more complete, more stable, or a combination thereof, in a number of embodiments, and can also result in a heat pump that is more efficient, including, for example, in one or more modes of operation (e.g., act 403, 404, 405, 406, or a combination thereof) where all of the heat exchangers (e.g., 170, 180, and 190) are being used to transfer heat.

In a number of embodiments, the heat pump (e.g., 500) includes a digital controller (e.g., 130) having programming instructions (e.g., 135) to manage refrigerant charge during conditions under which a particular heat exchanger is not needed for transferring heat, by opening the refrigerant recovery valve (e.g., 151) and thereby removing idle refrigerant from the particular heat exchanger (e.g., through reversing valve 140, and one of refrigerant conduit 107 or 108, depending on which heat exchanger 170 or 180 is not needed for transferring heat). In the embodiment illustrated, the idle refrigerant is removed from the particular heat exchanger (e.g., 170 or 180) through eleventh refrigerant conduit 111, through refrigerant recovery valve 151, and through twelfth refrigerant conduit 112.

Further, the idle refrigerant is delivered from the particular heat exchanger (e.g., 170 or 180) to compressor 160 (i.e., through inlet port 162). Further still, while refrigerant recovery valve 151 is open, the heat pump is operated, including running compressor 160 and heating the water at water heat exchanger 190. In the two different modes of operation shown in FIGS. 5 and 6, the particular heat exchanger is either outdoor heat exchanger 170 or indoor heat exchanger 180. In the mode of operation shown in FIG. 5, the particular heat exchanger is outdoor heat exchanger 170, and in the mode of operation shown in FIG. 6, the particular heat exchanger is indoor heat exchanger 180. Even further, in the embodiment illustrated in FIGS. 5, and 6, eleventh refrigerant conduit 111 directly connects and exclusively connects refrigerant conduit 106 to refrigerant recovery valve 151, and twelfth refrigerant conduit 112 directly connects and exclusively connects refrigerant recovery valve 151 to refrigerant conduit 110.

In some embodiments of a heat pump, the outdoor heat exchanger includes a ground loop. Outdoor heat exchanger 170, shown in FIGS. 1, 2, 5, and 6, can be or include a ground loop, for example, in heat exchanger 100 or 500, as examples. As used herein, the term "ground loop" includes systems where the refrigerant tubing is routed through the ground and systems where heat is exchanged between the refrigerant and a secondary liquid loop, such as glycol, that is circulated through the ground. Further, as used herein, the term "ground loop" includes systems that exchange heat with ground water as well as systems that exchange heat with earth or rock.

Other embodiments include (e.g., among other things) various combinations or subcombinations of the above components. Examples include a heat pump (e.g., 500) that alternately heats and cools a space and also heats water, that includes an outdoor heat exchanger (e.g., 170) that transfers heat between refrigerant and outdoor air or a heat source/sink, an indoor heat exchanger (e.g., 180) that transfers heat between the refrigerant and indoor air, and a water heat exchanger (e.g., 190) that transfers heat from the refrigerant to water. Such embodiments can further include a compressor (e.g., 160) that compresses the refrigerant, the compressor having an inlet port (e.g., 162) and a discharge port (e.g., 164), a refrigerant management valve (e.g., 150), a reversing valve (e.g., 140) that switches the heat pump between a cooling mode wherein the space is cooled by the heat pump and a heating mode wherein the space is not cooled by the heat pump, and a refrigerant recovery valve (e.g., 151).

In a number of embodiments, such a heat pump (e.g., 500) includes various refrigerant conduits. These refrigerant conduits can include, for example, a fourth refrigerant conduit (e.g., 104), for example, connecting or directly connecting (e.g., exclusively connecting) the discharge port (e.g., 164) on the compressor (e.g., 160) to the water heat exchanger (e.g., 190, for instance, at water heat exchanger inlet 192), a sixth refrigerant conduit (e.g., 106) connecting (e.g., directly connecting) the refrigerant management valve (e.g., 150) to the reversing valve (e.g., 140), and a tenth refrigerant conduit (e.g., 110) connecting (e.g., directly connecting) the reversing valve (e.g., 140) to the inlet port (e.g., 162) on the compressor (e.g., 160). Further, various embodiments include a refrigerant recovery conduit (e.g., 111 and 112 combined) connecting the sixth refrigerant conduit (e.g., 106) to the tenth refrigerant conduit (e.g., 110). In a number of embodiments, the refrigerant recovery valve (e.g., 151) is located in the refrigerant recovery conduit (e.g., between eleventh refrigerant conduit 111 and twelfth refrigerant conduit 112).

As used herein, the terms "first," "second," "third," "fourth," and the like in the description and in the claims, are identifiers used for distinguishing between similar elements and not necessarily for describing a particular (e.g., sequential or chronological) order or arrangement. It is to be understood that the terms so used are interchangeable under appropriate circumstances. Further, as an example, an embodiment described as having a fourth refrigerant conduit, for example, does not necessarily include or require the first, second, or third refrigerant conduit, as described herein. Similarly, an embodiment described as having the fourth, sixth, and tenth refrigerant conduits does not necessarily include or require the fifth, seventh, eighth, or ninth refrigerant conduits, as described herein.

In various embodiments, the heat pump has two cooling modes where the space is cooled by the heat pump and the water is heated, the mode illustrated in FIG. 5 (e.g., act 401 of FIG. 4), and a mode where heat is also rejected through outdoor heat exchanger 170 (e.g., act 403). Further, in a number of embodiments, the heat pump has two water heating modes where the space is not cooled by the heat pump, the mode illustrated in FIG. 6 (e.g., act 402) where indoor heat exchanger 180 is not used, and a mode where indoor heat exchanger 180 is used to heat the space (e.g., act 404). In various embodiments, in all four of these modes, water can be heated at water heat exchanger 190. Further, a number of embodiments include two other modes where water is not heated, one where the space is cooled (e.g., act 405) and another where the space is heated (e.g., act 406).

In some embodiments, the heat pump (e.g., 500) further including a digital controller (e.g., 130) that includes programming instructions (e.g., 135) to manage refrigerant charge during conditions under which a particular heat exchanger is not needed for transferring heat, by opening the refrigerant recovery valve (e.g., 151 and thereby removing idle refrigerant from the particular heat exchanger through the refrigerant recovery conduit (e.g., 111 and 112) and through the refrigerant recovery valve (e.g., 151), and delivering the idle refrigerant from the particular heat exchanger to the compressor (e.g., 160, via inlet port 162), and while the refrigerant recovery valve (e.g., 151) is open, operating the heat pump (e.g., 500), including running the compressor (e.g., 160) and heating the water at the water heat exchanger (e.g., 190). In different modes of operation (e.g., shown in FIGS. 5 and 6), the particular heat exchanger is either the outdoor heat exchanger (e.g., 170) or the indoor heat exchanger (e.g., 180). Further, in some embodiments, the outdoor heat exchanger (e.g., 170) includes a ground loop.

Further, in various embodiments, such a heat pump can include a combination of other components, including refrigerant conduits, described herein. All conceivable combinations are contemplated. For example, in some embodiments, the heat pump further includes an outdoor expansion device (e.g., 175), an indoor expansion device (e.g., 185), and at least six of: the first, second, third, fifth, seventh, eighth, and ninth refrigerant conduits described herein. Other embodiments include a different number (i.e., rather than six) of these refrigerant conduits. For example, in some embodiments, the heat pump further includes at least one, two, three, four, five, or seven of the first, second, third, fifth, seventh, eighth, and ninth refrigerant conduits described herein.

In various embodiments, the first refrigerant conduit (e.g., 101) connects the outdoor heat exchanger to the outdoor expansion device, the second refrigerant conduit (e.g., 102) connects the indoor heat exchanger to the indoor expansion device, the third refrigerant conduit (e.g., 103) connects the outdoor expansion device to the indoor expansion device, the fifth refrigerant conduit (e.g., 105) connects the water heat exchanger to the refrigerant management valve, the seventh refrigerant conduit (e.g., 107) connects the reversing valve to the outdoor heat exchanger, the eighth refrigerant conduit (e.g., 108) connects the reversing valve to the indoor heat exchanger, the ninth refrigerant conduit (e.g., 109) connects the refrigerant management valve to the third refrigerant conduit, or a combination thereof. In some embodiments, some such connections can be direct or exclusive, as described herein, shown in the figures, or both.

In a number of embodiments, the refrigerant management valve (e.g., 150) is a three-way valve, the reversing valve (e.g., 140) is a four-way valve, the refrigerant recovery valve (e.g., 151) is a two-way valve, or a combination thereof. In some embodiments, however, the refrigerant management valve can consist of two (2) two-way valves, as another example. Further, in some embodiments, refrigerant management valve 150 and refrigerant recovery valve 151 are combined into one valve that performs all of the function described herein. Further still, as used herein, embodiments that separately identify a refrigerant management valve and refrigerant recovery valve include embodiments where these two valves are combined provided the functions recited by that embodiment are performed by that combined valve. Even further, in such an embodiment having a combined refrigerant management and refrigerant recovery valve, refrigerant conduit 111 may connect to refrigerant conduit 106 at an end of refrigerant conduit 106.

In various embodiments, in a first mode of operation, the refrigerant management valve (e.g., 150) operates (e.g., as shown in FIG. 5) to isolate the outdoor heat exchanger (e.g., 170), and in a second mode of operation, the refrigerant management valve (e.g., 150) operates (e.g., as shown in FIG. 6) to isolate the indoor heat exchanger (e.g., 180). In the embodiment shown (e.g., heat pump 500), which of these modes of operation (i.e., first or second mode of operation) the heat pump is operating in, (e.g., at a particular time) is determined by four-way valve or reversing valve 140), but the one refrigerant management valve (e.g., 150), in various embodiments, operates to isolate either heat exchanger (i.e., 170 or 180).

Moreover, in a number of embodiments, the refrigerant management valve (e.g., 150) has a first position and a second position, and when the refrigerant management valve (e.g., 150) is in the first position, the heat pump (e.g., 500) uses both the outdoor heat exchanger (e.g., 170) and the indoor heat exchanger (e.g., 180) to transfer heat, and when the refrigerant management valve (e.g., 150) is in the second position, the heat pump uses only one of the outdoor heat exchanger (e.g., 170) or the indoor heat exchanger (e.g., 180) to transfer heat. For example, in the embodiment illustrated, in the first position, refrigerant management valve 150 is positioned or switched such that refrigerant conduit 105 is connected through refrigerant management valve 150 to refrigerant conduit 106, and refrigerant conduit 109 is blocked by refrigerant management valve 150 from refrigerant conduit 105 or refrigerant conduit 106. In comparison, in the second position, refrigerant management valve 150 is positioned or switched such that refrigerant conduit 105 is connected through refrigerant management valve 150 to refrigerant conduit 109, and refrigerant conduit 106 is blocked by refrigerant management valve 150 from refrigerant conduit 105 or refrigerant conduit 109.

In various embodiments, for example, when the refrigerant management valve (e.g., 150) is in the first position, the space is conditioned (i.e., heated or cooled via indoor heat exchanger 180) and the water is heated (e.g., at water heat exchanger 190) by desuperheating, (e.g., in some embodiments, if needed, for instance, acts 403, 404, 405, and 406 shown in FIG. 4). Further, when the refrigerant management valve (e.g., 150) is in the second position, in a number of embodiments, the refrigerant is (e.g., fully) condensed in the water heat exchanger (e.g., rather than just being desuperheated), either in combination with space cooling (e.g., via indoor heat exchanger 180) or with extraction of heat (e.g., via outdoor heat exchanger 170) from the outdoor air or heat source/sink (e.g., ground). In a number of embodiments, this second position corresponds to or causes acts 401 and 402 (i.e., one at a time, for example, depending on the position of reversing valve 140).

In various embodiments, in a first mode of operation (e.g., act 401 shown in FIG. 4), the refrigerant recovery valve (e.g., 151) opens to draw refrigerant from the outdoor heat exchanger (e.g., 170) to the inlet port (e.g., 162) on the compressor (e.g., 160), and in a second mode of operation (e.g., act 402), the refrigerant recovery valve (e.g., 151) opens to draw refrigerant from the indoor heat exchanger (e.g., 180) to the inlet port (e.g., 162) on the compressor (e.g., 160). Further, in some embodiments, in the first mode of operation (e.g., act 401), the heat pump (e.g., 500) heats the domestic hot water with the water heat exchanger (e.g., 190) while cooling the space with the indoor heat exchanger (e.g., 180), including condensing the refrigerant in the water heat exchanger (e.g., 190) and managing refrigerant charge in the heat pump (e.g., 500) by removing liquid refrigerant from the outdoor heat exchanger (e.g., 170). Further still, in some embodiments, in the second mode of operation (e.g., act 402), the heat pump heats the domestic hot water with the water heat exchanger (e.g., 190) while extracting heat from the outdoor air or from the heat source/sink with the outdoor heat exchanger (e.g., 170) without heating the space with the indoor heat exchanger (e.g., 180) and without cooling the space with the indoor heat exchanger (e.g., 180), including condensing the refrigerant in the water heat exchanger (e.g., 190) and managing refrigerant charge in the heat pump by removing liquid refrigerant from the indoor heat exchanger (e.g., 180).

Even further, in some embodiments, in a third mode of operation (e.g., act 403 in FIG. 4), the heat pump (e.g., 500) heats the domestic hot water with the water heat exchanger (e.g., 190) while cooling the space with the indoor heat exchanger (e.g., 180) and while rejecting heat to the outdoor air or to the heat source/sink with the outdoor heat exchanger (e.g., 170), including desuperheating the refrigerant in the water heat exchanger (e.g., 190) and condensing the refrigerant in the outdoor heat exchanger (e.g., 190). Even further still, in some embodiments, in a fourth mode of operation (e.g., act 404), the heat pump heats the domestic hot water with the water heat exchanger (e.g., 190) while heating the space with the indoor heat exchanger (e.g., 180) and while extracting heat from the outdoor air or from the heat source/sink with the outdoor heat exchanger (e.g., 190), including desuperheating the refrigerant in the water heat exchanger (e.g., 190) and condensing the refrigerant in the indoor heat exchanger (e.g., 180).

Various embodiments of methods use a refrigerant recovery valve (e.g., 151), refrigerant recovery conduit (e.g., 111 and 112), or both. Examples include various methods of managing refrigerant charge in a heat pump (e.g., 500) that heats or cools a space and that also heats water, the heat pump including an outdoor heat exchanger (e.g., 170) that transfers heat between refrigerant and outdoor air or a heat source/sink, an indoor heat exchanger (e.g., 180) that transfers heat between the refrigerant and indoor air, a water heat exchanger (e.g., 190) that transfers heat from the refrigerant to water, a compressor (e.g., 160), and at least one expansion device (e.g., 175, 185, or both). Such a method can include, for example, in any order except where a particular order is explicitly indicated or otherwise required, at least certain acts. Such acts can include, for example, during conditions under which a particular heat exchanger (e.g., 170 or 180) of the heat pump is not needed for transferring heat, delivering refrigerant gas to the particular heat exchanger and driving liquid refrigerant out of the particular heat exchanger (e.g., act 301 shown in FIG. 3).

Other such acts include, in some embodiments, while the refrigerant gas is in the particular heat exchanger, isolating the particular heat exchanger against additional refrigerant flowing into the particular heat exchanger (e.g., act 302), and while the particular heat exchanger is isolated against additional refrigerant flowing into the particular heat exchanger, operating the heat pump (e.g., 500), including running the compressor (e.g., 160; e.g., act 303). Further, some such embodiments include an act, while the particular heat exchanger is isolated against additional refrigerant flowing into the particular heat exchanger (e.g., during act 302), of drawing refrigerant from the particular heat exchanger to the compressor (e.g., through refrigerant conduit 111, refrigerant recovery valve 151, refrigerant conduit 112, or a combination thereof), including running the compressor (e.g., 160).

In some embodiments or modes of operation, for example, the particular heat exchanger is the outdoor heat exchanger (e.g., 170), and in some embodiments or modes of operation, for instance, the particular heat exchanger is the indoor heat exchanger (e.g., 180). Certain embodiments include both of these modes of operation. Further, in some embodiments, the act of isolating the particular heat exchanger against additional refrigerant flowing into the particular heat exchanger (e.g., act 302) includes closing a particular electronic expansion valve, for example, that is connected to the particular heat exchanger with a particular refrigerant conduit. Even further, in some embodiments, the act of isolating the particular heat exchanger against additional refrigerant flowing into the particular heat exchanger (e.g., act 302) includes actuating a refrigerant management valve (e.g., 150) located in a water heater outlet refrigerant conduit (e.g., 105 and 106 combined) that connects the water heat exchanger (e.g., 190) to a reversing valve (e.g., 140) that is used to switch the heat pump between a heating mode, in which the heat pump heats the space (e.g., act 404 or 406), and a cooling mode, in which the heat pump cools the space (e.g., act 401, 403, or 405), or both. Further still, in some embodiments, the act of operating the heat pump (e.g., 500, act 302)) includes keeping the particular electronic expansion valve (e.g., 175 or 185) closed for at least a majority of the act of operating the heat pump (e.g., act 303).

In a number of embodiments, the act of drawing refrigerant from the particular heat exchanger to the compressor (e.g., 160) includes opening a refrigerant recovery valve (e.g., 151) located in a refrigerant recovery conduit (e.g., 111 and 112 combined) that connects the water heater outlet refrigerant conduit (e.g., 106 or 105 and 106 combined) to a compressor inlet refrigerant conduit (e.g., 110), wherein the compressor inlet refrigerant conduit (e.g., 110) connects the reversing valve (e.g., 140) to an inlet port (e.g., 162) on the compressor. In various embodiments, the refrigerant recovery conduit (e.g., 111) connects to the water heater outlet refrigerant conduit between the refrigerant management valve (e.g., 150) and the reversing valve (e.g., 140) (e.g., at sixth refrigerant conduit 106).

Further, some such embodiments include an act of adjusting the refrigerant charge (e.g., act 304 in FIG. 3) that takes place after the act (e.g., act 302) of isolating the particular heat exchanger against additional refrigerant flowing into the particular heat exchanger (e.g., while the particular heat exchanger is isolated against additional refrigerant flowing into it). In some embodiments, the act of adjusting the refrigerant charge (e.g., act 304) takes place during the act of operating the heat pump (e.g., act 303), and the act of adjusting the refrigerant charge (e.g., act 304) includes using, for example, the particular electronic expansion valve (e.g., 175 or 185, but not both at the same time) to let refrigerant into the particular heat exchanger (e.g., 170 or 180 but not both at the same time). Further still, in some embodiments, the act of adjusting the refrigerant charge (e.g., act 304) includes monitoring refrigerant subcooling at a water heat exchanger outlet (e.g., 194, or downstream thereof before refrigerant subcooling changes significantly) and letting refrigerant into the particular heat exchanger if the subcooling at the water heat exchanger outlet exceeds a predetermined subcooling threshold. Even further, in some embodiments, the act of drawing refrigerant from the particular heat exchanger to the compressor (e.g., 160) includes opening a refrigerant recovery valve (e.g., 151) located in a refrigerant recovery conduit (e.g., 111 and 112 combined) that connects a water heater outlet refrigerant conduit (e.g., 105, 106, or both) to a compressor inlet refrigerant conduit (e.g., 110).

In some embodiments, the heat pump or controller waits a certain amount of time after the refrigerant recovery valve (e.g., 151) is closed, or after the refrigerant management valve (e.g., 150) is operated and the one or more expansion valves are closed (e.g., 175 and 185) to isolate the particular heat exchanger, while the heat pump is operating (e.g., act 303), to determine whether the active system is properly charged. If the active system (e.g., heat pump 500 except for the particular heat exchanger) is overcharged after that amount of time, in a number of embodiments, the expansion valve (e.g., 175 or 185) is opened, for example, to reduce the charge in the active system (e.g., act 304). On the other hand, if the active system is undercharged after that amount of time (or at a later time, in a number of embodiments) in some embodiments, the refrigerant recovery valve (e.g., 151) is opened, for example, to increase the charge in the active system. In different embodiments, this amount of time can be, for example, 10, 20, 30, 40, 50, 60, 70, 80, 90, 100, 120, 150, 180, 210, 240, or 300 seconds, as examples, or within a range between any two such amounts of time, as further examples. In certain embodiments that do not include act 301 described herein of driving liquid refrigerant from the particular heat exchanger (e.g., by delivering refrigerant gas to the particular heat exchanger), the refrigerant recovery valve (e.g., 151) is opened soon (e.g., within 1, 2, 3, 4, 5, 7, 10, 15, 20, 30, 45, or 60 seconds, in different embodiments,) or immediately after the particular heat exchanger is isolated (e.g., act 302), for example, anticipating that refrigerant will need to be removed from the unused or particular heat exchanger in order to have an appropriate refrigerant charge in the active system.

In a number of embodiments, once the refrigerant management valve (e.g., 150) is opened, the refrigerant management valve remains open (e.g., under the control of the controller, for example, 130, via programming instructions 135) until one of the following occurs: (1) a predetermined time has passed, or (2) a predetermined measured value is reached, for example, whichever [i.e., (1) or (2)] occurs first. Such a predetermined time can be, for example, 2, 5, 10, 15, 20, 30, 40, 50, 60, 70, 80, 90, 100, 120, 150, 180, 210, 240, or 300 seconds, as examples, or within a range between any two such amounts of time, as further examples. Further, such a predetermined measured value can be, for example, a pressure or a temperature of the refrigerant with in the heat pump, as examples.

Further still, in a number of embodiments, the refrigerant recovery valve (e.g., 151) is opened during operation of the heat pump (e.g., 500) to remove refrigerant from the particular heat exchanger (e.g., 170 or 180), or an expansion valve (e.g., 175 or 185) is opened to let refrigerant into the particular heat exchanger (e.g., act 304), to optimize, or better optimize, for example, refrigerant charge in the heat pump, while the heat pump is operating (e.g., in act 303). For instance, in some embodiments, refrigerant charge can optimized or adjusted when refrigerant has leaked into the particular heat exchanger or when one or more operating conditions has changed, for example, when water temperature, outdoor air temperature, space temperature, demand for hot water, or demand for space heating or cooling has changed, or a combination thereof. Optimization of refrigerant charge, in a number of embodiments, can improve efficiency, capacity, or both, of the heat pump. Even further, in certain embodiments, the refrigerant recovery valve (e.g., 151) is opened during operation of the heat pump (e.g., 500) to remove refrigerant from the particular heat exchanger (e.g., 170 or 180), an expansion valve (e.g., 175 or 185) is opened to let refrigerant into the particular heat exchanger (e.g., act 304), or both, repeatedly while the heat pump is operating (e.g., in act 303) to optimize, or better optimize, for example, refrigerant charge in the heat pump.

Another example of a method is a method of managing refrigerant charge in a heat pump (e.g., 500) that includes, for example, in any order except where a particular order is explicitly indicated, at least the acts of, during conditions under which a particular heat exchanger (e.g., 170 or 180) of the heat pump is not needed for transferring heat, isolating the particular heat exchanger against additional refrigerant flowing into the particular heat exchanger (e.g., act 302), and while the particular heat exchanger is isolated against additional refrigerant flowing into the particular heat exchanger, drawing refrigerant from the particular heat exchanger to the inlet port (e.g., 162) of the compressor (e.g., 160), including running the compressor, wherein the act of drawing refrigerant from the particular heat exchanger to the inlet of the compressor includes opening a refrigerant recovery valve (e.g., 151). In some embodiments, for example, such a method does not include act 301 described herein.

In some embodiments, such a method includes monitoring at least one parameter of the heat pump (e.g., 500), the at least one parameter indicative of whether the refrigerant charge in the heat pump is appropriate, and when the refrigerant charge in the heat pump is appropriate, based on the at least one parameter, closing the refrigerant recovery valve (e.g., 151). Examples of such a parameter include temperature, pressure, or both, of the refrigerant, at one or more particular locations within the heat pump. In a number of such embodiments, such a method can further include, after the act of closing the refrigerant recovery valve, continuing to operate the heat pump, including running the compressor while the particular heat exchanger is isolated (e.g., in act 302) against additional refrigerant flowing into the particular heat exchanger, and including continuing to monitor the at least one parameter of the heat pump, and when the refrigerant charge in the heat pump is below what is appropriate, based on the at least one parameter, opening the refrigerant recovery valve (e.g., 151) until the refrigerant charge in the heat pump is appropriate based on the at least one parameter.

In some such embodiments, the act of isolating the particular heat exchanger against additional refrigerant flowing into the particular heat exchanger (e.g., act 302) includes closing a particular electronic expansion valve (e.g., 175 or 185) that is connected to the particular heat exchanger with a particular coil inlet refrigerant conduit (e.g., 101 or 102). Further, in some embodiments, the act of isolating the particular heat exchanger against additional refrigerant flowing into the particular heat exchanger includes actuating a refrigerant management valve (e.g., 150) located in a water heater outlet refrigerant conduit (e.g., 105 and 106) that connects the water heat exchanger (e.g., 190) to a reversing valve (e.g., 140) that is used to switch the heat pump between a heating mode (e.g., 402 shown in FIG. 4), in which the heat pump does not cool the space, and a cooling mode (e.g., 401), in which the heat pump cools the space.

In various embodiments, the refrigerant recovery valve (e.g., 151) is located in a refrigerant recovery conduit (e.g., 111 and 112) that connects the water heater outlet refrigerant conduit (e.g., 105 and 106, in the embodiment shown, at 106) to a compressor inlet refrigerant conduit (e.g., 110). In a number of embodiments, the water heater outlet refrigerant conduit connects the water heat exchanger (e.g., 190) to a reversing valve (e.g., 140) that is used to switch the heat pump between a heating mode (e.g., act 402, 404, or 406), in which the heat pump does not cool the space, and a cooling mode (e.g., act 401, 403, or 405), in which the heat pump cools the space, and the compressor inlet refrigerant conduit (e.g., 110) connects the reversing valve (e.g., 140) to the inlet (e.g., 162) of the compressor (e.g., 160). In particular embodiments, the refrigerant recovery conduit (e.g., 111) connects to the water heater outlet refrigerant conduit between a refrigerant management valve and the reversing valve (e.g., at refrigerant conduit 106).

In some embodiments, the act of monitoring at least one parameter of the heat pump (e.g., 500) includes monitoring refrigerant subcooling. Further, in certain embodiments, the act of monitoring at least one parameter of the heat pump includes monitoring refrigerant subcooling at a water heat exchanger outlet (e.g., 194 or at refrigerant conduit 105, refrigerant management valve 150, refrigerant conduit 109, or refrigerant conduit 103, as examples).

Yet another example of a method is a method of heating and cooling a space and also of heating domestic hot water, the method including, for example, in any order except where a particular order is explicitly indicated or otherwise required, at least the acts of, in a first mode of operation (e.g., act 401), heating the domestic hot water with the water heat exchanger (e.g., 190) while cooling the space with the indoor heat exchanger (e.g., 180), the first mode of operation including condensing the refrigerant in the water heat exchanger (e.g., 190) and managing refrigerant charge in the heat pump (e.g., 500) by removing liquid refrigerant from the outdoor heat exchanger (e.g., 170), and in a second mode of operation (e.g., act 402), heating the domestic hot water with the water heat exchanger (e.g., 190) while extracting heat from the outdoor air or from the heat source/sink with the outdoor heat exchanger (e.g., 170), without heating the space with the indoor heat exchanger (e.g., 180) and without cooling the space with the indoor heat exchanger, the second mode of operation including condensing the refrigerant in the water heat exchanger (e.g., 190) and managing refrigerant charge in the heat pump by removing liquid refrigerant from the indoor heat exchanger (e.g., 180).

Such a method can also include, in a number of embodiments, in a third mode of operation (e.g., 403), heating the domestic hot water with the water heat exchanger (e.g., 190) while cooling the space with the indoor heat exchanger (e.g., 180) and while rejecting heat to the outdoor air or to the heat source/sink with the outdoor heat exchanger (e.g., 170), the third mode of operation including desuperheating the refrigerant in the water heat exchanger (e.g., 190) and condensing the refrigerant in the outdoor heat exchanger (e.g., 170), and in a fourth mode of operation (e.g., act 404), heating the domestic hot water with the water heat exchanger (e.g., 190) while heating the space with the indoor heat exchanger (e.g., 180) and while extracting heat from the outdoor air or from the heat source/sink with the outdoor heat exchanger (e.g., 170), the fourth mode of operation including desuperheating the refrigerant in the water heat exchanger (e.g., 190) and condensing the refrigerant in the indoor heat exchanger (e.g., 180).

In some embodiments, for example, the act in the first mode of operation (e.g., act 401) of managing refrigerant charge in the heat pump (e.g., 500) by removing liquid refrigerant from the outdoor heat exchanger (e.g., 170) includes delivering refrigerant gas to the outdoor heat exchanger and driving liquid refrigerant out of the outdoor heat exchanger (e.g., act 301), while the refrigerant gas is in the outdoor heat exchanger, isolating the outdoor heat exchanger against additional refrigerant flowing into the outdoor heat exchanger (e.g., act 302), and while the outdoor heat exchanger is isolated against additional refrigerant flowing into the outdoor heat exchanger, operating the heat pump (e.g., act 303), including running the compressor (e.g., 160). Further, in some embodiments, the act in the second mode of operation (e.g., act 402) of managing refrigerant charge in the heat pump by removing liquid refrigerant from the indoor heat exchanger (e.g., 180) includes delivering refrigerant gas to the indoor heat exchanger and driving liquid refrigerant out of the indoor heat exchanger (e.g., act 301), while the refrigerant gas is in the indoor heat exchanger, isolating the indoor heat exchanger against additional refrigerant flowing into the indoor heat exchanger (e.g., act 302), and while the indoor heat exchanger is isolated against additional refrigerant flowing into the indoor heat exchanger, operating the heat pump (e.g., act 303), including running the compressor.

Various embodiments of the subject matter described herein include various combinations of the acts, structure, components, and features described herein, shown in the drawings, or known in the art. Moreover, certain procedures may include acts such as obtaining or providing various structural components described herein, obtaining or providing components that perform functions described herein. Furthermore, various embodiments include advertising and selling products that perform functions described herein, that contain structure described herein, or that include instructions to perform functions described herein, as examples. Such products may be obtained or provided through distributors, dealers, or over the Internet, for instance. The subject matter described herein also includes various means for accomplishing the various functions or acts described herein or apparent from the structure and acts described.

What is claimed is:

1. A heat pump that heats or cools a space and also heats water, the heat pump comprising:

an outdoor heat exchanger that transfers heat between refrigerant and outdoor air or a heat source/sink;

an indoor heat exchanger that transfers heat between the refrigerant and indoor air;

a water heat exchanger that transfers heat from the refrigerant to water;

a compressor;

an outdoor expansion device;

an indoor expansion device;

a refrigerant management valve;

a reversing valve;

a first refrigerant conduit connecting the outdoor heat exchanger to the outdoor expansion device;

a second refrigerant conduit connecting the indoor heat exchanger to the indoor expansion device;

a third refrigerant conduit connecting the outdoor expansion device to the indoor expansion device;

a fourth refrigerant conduit connecting a discharge port on the compressor to the water heat exchanger;

a fifth refrigerant conduit connecting the water heat exchanger to the refrigerant management valve;

a sixth refrigerant conduit connecting the refrigerant management valve to the reversing valve;

a seventh refrigerant conduit connecting the reversing valve to the outdoor heat exchanger;

an eighth refrigerant conduit connecting the reversing valve to the indoor heat exchanger;

a ninth refrigerant conduit connecting the refrigerant management valve to the third refrigerant conduit;

a tenth refrigerant conduit connecting the reversing valve to an inlet port on the compressor; and a digital controller comprising programming instructions configured to manage refrigerant charge during conditions under which a particular heat exchanger is not needed for transferring heat by:

delivering refrigerant gas to the particular heat exchanger and driving liquid refrigerant out of the particular heat exchanger;

while the refrigerant gas is in the particular heat exchanger, isolating the particular heat exchanger against additional refrigerant flowing into the particular heat exchanger by controlling the refrigerant management valve and by controlling the outdoor expansion device or the indoor expansion device; and while the particular heat exchanger is isolated against additional refrigerant flowing into the particular heat exchanger, operating the heat pump including running the compressor and heating the water at the water heat exchanger;

wherein the particular heat exchanger is either the outdoor heat exchanger or the indoor heat exchanger.

2. The heat pump of claim 1 wherein the digital controller comprises programming instructions configured to manage refrigerant charge by controlling the outdoor expansion device and the indoor expansion device.

3. The heat pump of claim 1 wherein the third refrigerant conduit directly connects the outdoor expansion device to the indoor expansion device.

4. The heat pump of claim 1 wherein the fourth refrigerant conduit directly connects the discharge port on the compressor to the water heat exchanger.

5. The heat pump of claim 1 wherein the sixth refrigerant conduit directly connects the refrigerant management valve to the reversing valve.

6. The heat pump of claim 1 wherein the third refrigerant conduit directly connects the outdoor expansion device to the indoor expansion device; the fourth refrigerant conduit directly connects the discharge port on the compressor to the water heat exchanger; and the sixth refrigerant conduit directly connects the refrigerant management valve to the reversing valve.

7. The heat pump of claim 1 wherein the outdoor heat exchanger comprises a ground loop.

8. A heat pump that alternately heats and cools a space and also heats water, the heat pump comprising:

an outdoor heat exchanger that transfers heat between refrigerant and outdoor air or a heat source/sink;

an indoor heat exchanger that transfers heat between the refrigerant and indoor air;

a water heat exchanger that transfers heat from the refrigerant to water;

a compressor that compresses the refrigerant, the compressor having an inlet port and a discharge port;

a refrigerant management valve;

a reversing valve that switches the heat pump between a cooling mode wherein the space is cooled by the heat pump and a heating mode wherein the space is not cooled by the heat pump;

a fourth refrigerant conduit directly connecting the discharge port on the compressor to the water heat exchanger;

a sixth refrigerant conduit connecting the refrigerant management valve to the reversing valve;

a tenth refrigerant conduit connecting the reversing valve to the inlet port on the compressor; and a digital controller comprising programming instructions configured to: manage refrigerant charge during conditions under which a particular heat exchanger is not needed for transferring heat by delivering refrigerant gas to the particular heat exchanger and driving liquid refrigerant out of the particular heat exchanger, and then while the refrigerant gas is in the particular heat exchanger, isolating the particular heat exchanger against additional refrigerant flowing into the particular heat exchanger by controlling the refrigerant management valve and by controlling an outdoor expansion device or an indoor expansion device, and while the particular heat exchanger is isolated against additional refrigerant flowing into the particular heat exchanger, operating the heat pump including running the compressor and heating the water at the water heat exchanger, wherein the particular heat exchanger is either the outdoor heat exchanger or the indoor heat exchanger.

9. The heat pump of claim 8 wherein the outdoor heat exchanger comprises a ground loop.

10. The heat pump of claim 8 further comprising the outdoor expansion device, the indoor expansion device, and at least six of:

a first refrigerant conduit connecting the outdoor heat exchanger to the outdoor expansion device;

a second refrigerant conduit connecting the indoor heat exchanger to the indoor expansion device;

a third refrigerant conduit connecting the outdoor expansion device to the indoor expansion device;

a fifth refrigerant conduit connecting the water heat exchanger to the refrigerant management valve;

a seventh refrigerant conduit connecting the reversing valve to the outdoor heat exchanger;

an eighth refrigerant conduit connecting the reversing valve to the indoor heat exchanger; or a ninth refrigerant conduit connecting the refrigerant management valve to the third refrigerant conduit.

11. The heat pump of claim 8 wherein: the refrigerant management valve is a three-way valve; and the reversing valve is a four-way valve.

12. The heat pump of claim 8 wherein: in a first mode of operation, the refrigerant management valve operates to isolate the outdoor heat exchanger; and in a second mode of operation, the refrigerant management valve operates to isolate the indoor heat exchanger.

13. The heat pump of claim 8 wherein:

the refrigerant management valve has a first position and a second position;

when the refrigerant management valve is in the first position, the heat pump uses both the outdoor heat exchanger and the indoor heat exchanger to transfer heat; and when the refrigerant management valve is in the second position, the heat pump uses only one of the outdoor heat exchanger or the indoor heat exchanger to transfer heat.

14. The heat pump of claim 8 wherein:

in a first mode of operation, the heat pump heats the domestic hot water with the water heat exchanger while cooling the space with the indoor heat exchanger, including condensing the refrigerant in the water heat exchanger and managing refrigerant charge in the heat pump by removing liquid refrigerant from the outdoor heat exchanger;

in a second mode of operation, the heat pump heats the domestic hot water with the water heat exchanger while extracting heat from the outdoor air or from the heat source/sink with the outdoor heat exchanger without heating the space with the indoor heat exchanger and without cooling the space with the indoor heat exchanger, including condensing the refrigerant in the water heat exchanger and managing refrigerant charge in the heat pump by removing liquid refrigerant from the indoor heat exchanger;

in a third mode of operation, the heat pump heats the domestic hot water with the water heat exchanger while cooling the space with the indoor heat exchanger and while rejecting heat to the outdoor air or to the heat source/sink with the outdoor heat exchanger, including desuperheating the refrigerant in the water heat exchanger and condensing the refrigerant in the outdoor heat exchanger; and in a fourth mode of operation, the heat pump heats the domestic hot water with the water heat exchanger while heating the space with the indoor heat exchanger and while extracting heat from the outdoor air or from the heat source/sink with the outdoor heat exchanger, including desuperheating the refrigerant in the water heat exchanger and condensing the refrigerant in the indoor heat exchanger.

15. The heat pump of claim 8 wherein the digital controller comprises programming instructions to configured open and then close the outdoor expansion device or the indoor expansion device to let refrigerant into the particular heat exchanger to adjust refrigerant charge.

16. The heat pump of claim 1 wherein the digital controller comprises programming instructions to configured use at least one of the outdoor expansion device, the indoor expansion device, or the refrigerant management valve to let refrigerant into the particular heat exchanger to adjust refrigerant charge.

* * * * *